US009486993B2

(12) United States Patent
Kress et al.

(10) Patent No.: US 9,486,993 B2
(45) Date of Patent: Nov. 8, 2016

(54) METHOD AND DEVICE FOR SETTING INK-CONDUCTING ROTATIONAL BODIES OF A PRINTING PRESS

(71) Applicant: Koenig & Bauer AG, Würzburg (DE)

(72) Inventors: Patrick Kress, Bad Mergentheim-Edelfingen (DE); Martin Palme, Kist (DE); Volkmar Schwitzky, Würzburg (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 14/894,541

(22) PCT Filed: May 23, 2014

(86) PCT No.: PCT/EP2014/060612

§ 371 (c)(1),
(2) Date: Nov. 30, 2015

(87) PCT Pub. No.: WO2015/032514

PCT Pub. Date: Mar. 12, 2015

(65) Prior Publication Data

US 2016/0129684 A1 May 12, 2016

(30) Foreign Application Priority Data

Sep. 9, 2013 (DE) ..... 10 2013 217 942

(51) Int. Cl.
*B41F 31/34* (2006.01)
*B41F 3/58* (2006.01)
*B41F 13/36* (2006.01)

(52) U.S. Cl.
CPC ..... *B41F 3/58* (2013.01); *B41F 13/36* (2013.01); *B41F 31/34* (2013.01)

(58) Field of Classification Search
USPC ..... 101/352.01
See application file for complete search history.

(56) References Cited

U.S. PATENT DOCUMENTS 4,094,243 A 6/1978 Braun
5,282,417 A 2/1994 Germann (Continued)

FOREIGN PATENT DOCUMENTS

DE 2627963 B2 11/1977
DE 240172 A5 10/1986

(Continued)

OTHER PUBLICATIONS

International Search Report of PCT/EP2014/060612.

(Continued)

*Primary Examiner* — Joshua D Zimmerman
(74) *Attorney, Agent, or Firm* — Mattingly & Malur, PC

(57) ABSTRACT

Rotational bodies of a printing press with at least a first, a second and a third ink-conducting rotational body, which interact with each other in pairs, can be set in a thrown-on position. The second of the at least three rotational bodies can be set both against the first of the three rotational bodies and against the third of the three rotational bodies in order to form a two-sided thrown-on position. Tracking, coupled in a defined way, of the rotational axis of the second rotational body takes place at the same time as a radial positional change of the rotational axis of the first rotational body, by the superimposition of two movements along two non-congruent movement paths which run in a plane which is perpendicular with respect to the rotational axis. A device for setting rotational bodies of a printing press is also provided.

16 Claims, 15 Drawing Sheets

(56) References Cited

U.S. PATENT DOCUMENTS

| | | | |
|---|---|---|---|
| 5,355,796 | A | 10/1994 | Kobler |
| 5,782,182 | A | 7/1998 | Ruckmann et al. |
| 6,058,842 | A | 5/2000 | Mayr |
| 6,684,775 | B2 | 2/2004 | Dufour et al. |
| 6,712,001 | B2 | 3/2004 | Plewa |
| 7,011,020 | B2 | 3/2006 | Dunninger et al. |
| 7,395,758 | B2 | 7/2008 | Kusaka |
| 8,459,181 | B2 | 6/2013 | Saito |
| 2006/0266238 | A1 | 11/2006 | Derhardt |
| 2011/0100240 | A1 | 5/2011 | Kundgen et al. |

FOREIGN PATENT DOCUMENTS

| | | | |
|---|---|---|---|
| DE | 4142791 | A1 | 6/1993 |
| DE | 4211379 | A1 | 10/1993 |
| DE | 19701216 | A1 | 7/1998 |
| DE | 19719304 | C1 | 11/1998 |
| DE | 10158093 | A1 | 6/2003 |
| DE | 10328801 | A1 | 2/2004 |
| DE | 102005014255 | A1 | 10/2006 |
| DE | 102007009884 | A1 | 9/2007 |
| DE | 102010048364 | A1 | 5/2011 |
| EP | 0563007 | A1 | 9/1993 |
| EP | 1088658 | A1 | 4/2001 |
| EP | 1264686 | A1 | 12/2002 |
| EP | 1280666 | A1 | 2/2003 |
| EP | 1724115 | A2 | 11/2006 |
| EP | 1961564 | A2 | 8/2008 |
| JP | 63-126748 | A | 5/1988 |
| WO | 95/24314 | A1 | 9/1995 |
| WO | 01/83214 | A1 | 11/2001 |

OTHER PUBLICATIONS

Handbook of Print Media, Helmut Kipphan (ISBN 3-540-67326-1).

b)

a)

METHOD AND DEVICE FOR SETTING INK-CONDUCTING ROTATIONAL BODIES OF A PRINTING PRESS

CROSS-REFERENCE TO RELATED APPLICATIONS

This application is a U.S. National Phase, under 35 U.S.C. §371, of PCT/EP2014/060612, filed May 23, 2014; published as WO 2015/032514 A1 on Mar. 12, 2015 and claiming priority to DE 10 2013 217 942.1, filed Sep. 9, 2013, the disclosures of which are expressly incorporated herein by reference in their entireties.

FIELD OF THE INVENTION

The invention relates to a method and a device for setting preferably ink-conducting rotational bodies, in particular cylinders, of a printing press. Rotational bodies of a printing press and having at least a first, a second and a third ink-conducting rotational body interact with each other in pairs in a thrown-on position. The second of the at least three rotational bodies is set both against the first of the three rotational bodies and against the third of the three rotational bodies to form a two-sided thrown-on position. The second of the at least three rotational bodies is radially movably mounted in a one or a multi-piece frame between the first and the third rotational bodies so that it can be selectively brought into a thrown-on position in which it is set against the first rotational body and the third rotational body, or into a thrown-off position in which it is out of contact with at least one of the two other rotational bodies. For mounting of the second rotational body, a bearing arrangement is provided at the front comprising two adjusting elements for the radial movement of the second rotational body by way of superimposition of two non-congruent movements, each having a radial movement component.

BACKGROUND OF THE INVENTION

From a chapter relating to security printing in the specialist book "Handbuch der Printmedien" ["Handbook of Print Media"] Helmut Kipphan, Springer, 2000, a printing unit of a security printing press with an Orlof printing unit is known, wherein a transfer cylinder interacts with an Orlof plate cylinder and the latter with an ink collecting cylinder. The printing unit further comprises an additional offset printing unit that forms an additional nip point with the transfer cylinder for inking thereof. The sheet delivery is performed away from the transfer cylinder of the Orlof printing unit diagonally towards the back of a bottom delivery tray.

EP 1 264 686 A1 discloses a web-fed rotary offset printing press having four vertically stacked double printing units, which is separable between the forme cylinder and the associated inking units for set up purposes.

In WO 95/24314 A1 four double printing units of a printing tower are also disclosed, wherein the double printing units can be separated at the printing positions between the interacting transfer cylinders for servicing purposes.

EP 0 563 007 A1 discloses an intaglio printing press, the cylinders of which are mounted on three sectional frames that can be separated from each other in order to allow a switch from an indirect- and a direct printing method upon removal of the middle section.

EP 1 280 666 B1 discloses a multi-ring bearing for setting a distance between cylinders, in particular the distance between a transfer cylinder to both a forme cylinder and to an impression cylinder, where the latter may also be movably mounted in the radial direction between a print-on-position and a print-off-position. The transfer cylinder can be brought out of contact with the impression- and the forme cylinder by means of a first eccentric bearing, and the width of the printing gap can be adjusted by means of a second eccentric bearing.

WO 01/83214 A1 discloses a multi-ring bearing for setting a distance between cylinders, in particular the distance between a transfer cylinder to both a forme cylinder and to an impression cylinder, where the latter may also be movably mounted in the radial direction between a print-on-position and a print-off-position. The transfer cylinder can be brought out of contact from the impression- and the forme cylinder by means of a first eccentric bearing, and the width of the printing gap can be adjusted by means of a second eccentric bearing.

In an anilox inking unit of DE 42 11 379 A1, an ink form roller is mounted in a multi-ring bearing comprising two eccentric bearings. Throw-on and throw-off is accomplished by movement of one of the eccentric rings against a limit stop by means of a working cylinder engaging with one of the eccentric rings. This limit stop as well as the second eccentric ring are each motor-adjustable in order to set the imprint width in the two nip points.

EP 1 088 658 B1 discloses an ink form roller of a short inking unit mounted in a four-ring bearing between a forme cylinder and an anilox roller, which, during the printing operation, and timed with the rotation of the forme cylinder is alternately thrown-on or thrown-off from the latter. The nip point between the ink form roller and the anilox roller is thereby to stay in engagement during the printing operation, while it must be separated during printing interruption.

DE 101 58 093 A1 discloses a gravure press in which the printing unit cylinders that form the printing position are mounted in a first, stationary frame section, an Orlof cylinder and interacting stencil cylinder are mounted in a second frame section that can be moved away from the first frame section, and the inking units that ink the stencil cylinders during operation are mounted in a third frame section that can be moved away from the second frame section.

DD 240 172 A5 discloses a printing press for securities printing with an Orlof offset printing press, comprising a plurality of stencil cylinders that are each inkable by an associated inking unit, an ink collecting cylinder cooperatively interacting with the stencil cylinders, an Orlof plate cylinder interacting with the ink collecting cylinder, a transfer cylinder interacting with the Orlof plate cylinder, and an impression cylinder forming a printing position together with the transfer cylinder. In addition, two printing units are provided, the plate cylinders of which form two additional nip points with the transfer cylinder for inking thereof. In one embodiment of the printing press with horizontal web travel, the aforementioned cylinders are mounted in a stationary main frame, while the inking units interacting with both the stencil cylinders and the plate cylinders are mounted on either side of the main frame in removable inking carriages. Laterally moveable inking carriages are further provided for the inking units interacting with the impression cylinder.

DE 10 2005 014 255 A1 relates to a mounting of rollers and/or cylinders, the cones of which are thereby mounted in eccentric bearings that are rotatable by adjusting elements so as to change the distances between the axes. To dampen the vibrations caused by tension channels during unwinding, rotatably mounted support discs are provided on the cones, and support elements arranged between the support discs of respective adjacent rollers/cylinders. The print quality is controlled by a shared control device by variation of the axis distances of the means acting on the eccentric adjusting means of one or several of the rollers or cylinders. The support elements are tracked when one or several of the axis distances are varied.

DE 103 28 801 A1 discloses a device for setting print-on and print-off in a printing press, wherein a middle cylinder designed as forme- and/or blanket cylinder can be set via a cam ring of a so-called three-point bearing. A forme roller can be brought into contact with the forme- and/or blanket cylinder, which is mounted in an adjusting element designed as an eccentric bearing.

DE 26 27 963 B1 discloses a device for adjusting ink forme rollers, wherein the inking rollers set to a certain contact pressure are moved at the same time as when the plate cylinders are set, while maintaining the contact pressure.

DE 41 42 791 A1 discloses a device for adjusting the printing pressure as well as the print-on and print-off position in printing presses.

DE 197 19 304 C1 discloses a bearing arrangement for a roller of an inking- or damping unit that can be thrown-on.

DE 10 2007 009 884 A1 discloses a printing press with a forme-, a transfer-, and an impression cylinder, wherein a switchable adjusting device is provided for setting, via a an actuator device, the print-on/print-off position, and that engages with the rubber cylinder, and an adjusting device is provided that engages with the rubber cylinder and is driveable by a first adjusting drive, by means of which an adjustment of the engagement pressure in the printing gap can be performed. In addition, a tracking system is provided that acts on the forme cylinder, the adjusting drive of which is electronically coupled with the first adjusting drive that sets the rubber cylinder in such a way that the forme cylinder is automatically tracked when the printing gap is adjusted.

DE 197 01 216 A1 relates to an arrangement for adjusting the printing pressure between a plate- and a rubber cylinder and between the rubber- and an impression cylinder, where, for this purpose, the plate- and the rubber cylinder are mounted in eccentric bearings on both sides. In order to track the plate cylinder in a suitable way with the adjusting movement of the rubber cylinder, so as to adjust the printing gap to the printing material thickness, the adjusting eccenters of the plate- and rubber cylinder are driven by respective adjusting gearings via an adjusting screw.

EP 1 724 115 A2 discloses a gravure press with a gravure cylinder, which is inked by a ink collecting cylinder, which in turn is supplied on its perimeter with printing ink by several stencil cylinders. These types of printing presses are used in securities printing.

SUMMARY OF THE INVENTION

The problem to be solved by the invention is to provide a method and a device for setting ink-conducting rotational bodies, in particular cylinders of a printing press.

The problem is solved by the present invention. Tracking, coupled in a defined way, of the rotational axis of the second rotational body, takes place at the same time as a radial positional change of the rotational axis of the first rotational body, by way of the superimposition of its two movements along two non-congruent movement paths which run in a plane which is perpendicular with respect to the rotational axis. A forced two-sided tracking of the second rotational body is provided, which comprises a coupling of a movement of the two adjusting elements to a radial movement of the first rotational body in a defined way such that a radial movement of the first rotational body over a travel greater than zero at the same effects a forced tracking of the two adjusting elements positioning the first rotational body each by a defined travel distance that is greater than zero.

The advantages achievable by the invention are in particular that the printing press, in particular the printing press designed as a security printing press having an Orlof offset printing unit, can be effectively and safely run and/or operated despite its complex design.

A further particular advantage in one embodiment with forced tracking is that thereby the risk of printing faults and/or macules can be considerably reduced in a comfortable and safe manner.

This is achieved in particular by the fact that during setting of rotational bodies of a printing press having three ink-conducting rotational bodies, which interact in each case in pairs in a thrown-on position, wherein a second, i.e. for example a middle, of the three rotational bodies is set both against the first of the three rotational bodies and against the third of the three rotational bodies in order to form a two-sided thrown-on position, wherein tracking, coupled in a defined way, of the rotational axis of the second rotational body takes place at the same time as a radial positional change of the rotational axis of the first rotational body, by way of the superimposition of two movements along two non-congruent movement paths which run in a plane which is perpendicular with respect to the rotational axis.

Preferably, a second of the three rotational bodies, i.e. for example mounted between the first and third rotational body in a one- or multi-frame, is radially moveably mounted in a one- or multi-piece frame in such a way that it can be selectively brought into a thrown-on position in which it is in contact with the first rotational body and the third rotational body, or brought into a thrown-off position in which it is brought out of contact with at least one of the two other rotational bodies, whereby a bearing arrangement at the front side is provided, which comprises two adjusting elements in order to move the second rotational body in the radial direction by way of the superimposition of two non-congruent movements, each having one radial movement component. A forced, two-sided tracking of the second rotational body is thereby provided, which comprises a coupling, in a defined way, of a movement of the two adjusting elements to a radial movement of the first rotational body, so that a radial movement of the first rotational body about a travel greater than zero effects a forced tracking of the two adjusting elements that each position the first rotational body by a defined travel that is greater than zero.

The aforementioned tracking, or the aforementioned features further developing the tracking, as they are described in the following and/or by means of the exemplary embodiments, can be added individually or in combination for a further advantageous development.

In one embodiment, the superimposition of the two movements can occur by simultaneous adjustment of a first adjusting element, in particular configured as a first eccentric ring, and a second adjusting element, in particular configured as a second eccentric ring.

An adjusting mechanism interacting with the adjusting elements may be provided for coupling, by means of which, in one embodiment, the readjustment of the two adjusting elements with respect to their movement is mechanically coupled, and in another embodiment coupled via electronic control means, to an adjusting mechanism or adjustment that effects the radial movement of the first rotational body.

In the embodiment with the forced two-sided tracking of the Orlof plate cylinder, it is possible to prevent maculates caused by faulty or incomplete inking—in particular in connection with securities printing. On the one hand, an increased level of print quality is imposed on securities printing, but on the other, because of the cost of the printing material and/or limited and controlled sheet numbers, any waste should be avoided as much as possible. Here, production interruptions may occur to a greater extent than during printing of less sensitive products. For example, in the event of inaccurate or even slightly incorrect sheet feed, an interruption of the production may be performed by the printer or a monitoring arrangement. In order to generate as little waste as possible after interruption, preferably no maculate by faulty printing, which may result, for example, by faulty, e.g. incomplete inking of cylinders and/or rollers, the rollers and cylinders should be correctly inked prior to resuming the printing process. This is accomplished, for example, by a two-sided forced tracking.

In addition to, or instead, there may be a particular advantage of one embodiment of an Orlof offset printing unit having separable sectional frames for ink collecting- and transfer cylinders, where the printing press, in particular the printing press configured as a securities printing press with an Orlof offset printing unit, is better accessible and/or modularly implementable or expandable for washing, installation or maintenance purposes despite its complex design.

This problem is solved in particular by a printing press, in particular for securities printing, having an Orlof offset printing unit comprising a plurality of stencil cylinders which are each inkable by an associated inking unit; an ink collecting cylinder interacting with the plurality of stencil cylinders; an Orlof plate cylinder interacting with the ink collecting cylinder; a transfer cylinder interacting with the Orlof plate cylinder; and an impression cylinder forming a print position with the transfer cylinder, achieved by the fact that the transfer cylinder that is interacting with the Orlof plate cylinder is contained, at least in print-on position, in a first printing unit section and is mounted in or on a first sectional frame; the ink collecting cylinder is contained in a second printing unit section and is mounted in or on a second sectional frame that is different from the first sectional frame, and by the first and the second sectional frame being able to be selectively brought into a first relative position forming a working position and into a second relative position forming a maintenance position with respect to each other, wherein in maintenance position a space is formed between the first and the second printing unit section and/or between the first and the second sectional frame that allows direct access to at least the ink collecting cylinder, to the Orlof plate cylinder and to the transfer cylinder interacting with the Orlof plate cylinder.

Preferably, during the switch of a printing form onto an Orlof plate cylinder of an Orlof offset printing unit arranged in a printing press for securities printing, and during start up of a production—wherein during standstill of the printing press a coupling, in particular a lock, between a first sectional frame containing the Orlof plate cylinder and a second sectional frame containing the ink collecting cylinder is disengaged; in the state of disengaged coupling, in particular locking, the first and the second sectional frame are moved by activation of a drive from a first relative position, i.e. a working position, into a second relative position, i.e. a maintenance position in which they are spaced further apart from one another and form an accessible space between one another; the unloaded Orlof plate cylinder freed across the space of any printing form from the previous production is loaded with at least one printing form for the impending production; after loading, the first and second sectional frame are brought by activation thereof or by an additional drive from the maintenance position back to the working position relative to each other; the coupling, in particular locking, between the first and the second sectional frame (47.1; 47.2) is re-established, and directly thereafter, or at an interval, the press is started.

The aforementioned separability, or the aforementioned further development of the feature relating to a switch as set out below and/or by the exemplary embodiments, can be added individually or in combination to produce an advantageous further development.

In an advantageous embodiment, the impression cylinder that is interacting with the transfer cylinder in print-on position can be contained in the first print unit section and be mounted in or on the first sectional frame, and/or the plurality of stencil cylinders can be contained in the second printing unit section and mounted in or on the second sectional frame that is different from the first sectional frame, and/or the Orlof plate cylinder can be included in the first printing unit section and be mounted in or on the first sectional frame.

By separation of the machine frame or the cylinder train in the printing unit, in particular of the ink collecting cylinder and the Orlof plate cylinder, and—in terms of the arrangement —spatial separation between the ink collecting cylinder and transfer cylinder and their relative positional changeability, the ink collecting cylinder and the transfer cylinder are accessible for loading or maintenance work, e.g. for washing or changing of the rubber blankets, and the Orlof plate cylinder is accessible for plate changes from the side. The upper side can remain open, so that in a space-saving manner—e.g. in a modular building-block manner—one or more additional printing units can be placed on top of the Orlof printing unit.

The side-accessibility of the parts defining the Orlof printing unit allows for a significant number of building modules or parts, in particular the connection and mounting of a substantial number of cylinders and rollers of the Orlof printing unit, to not have to significantly differ, due to its specific arrangement, from those, or from the type of connection and mounting of the cylinders and the rollers of a multiple-gathering offset printing unit, but can be used in identical design or with only minor deviations.

Exemplary embodiments of the invention are shown in the drawings and are described in more detail below.

DESCRIPTION OF PREFERRED EMBODIMENTS

Figure 1:
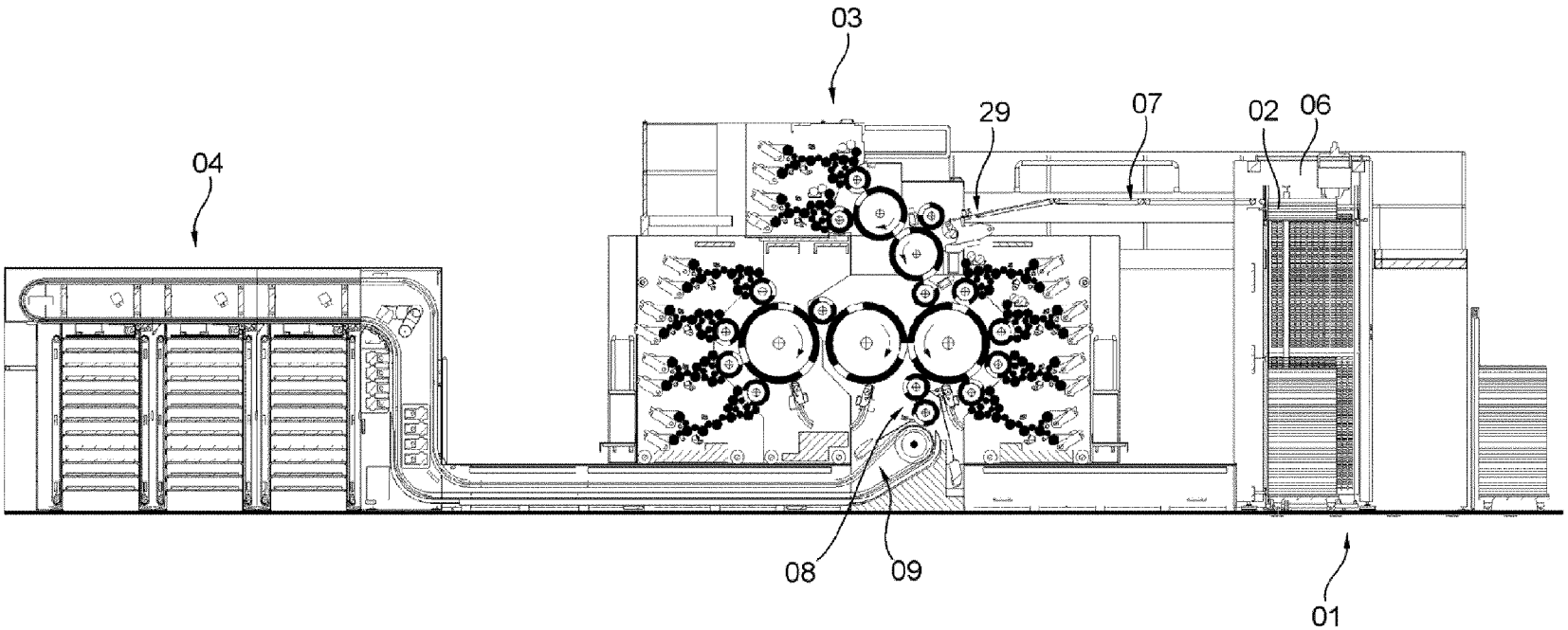
FIG. 1 an exemplary embodiment of a printing press comprising a printing unit.

A printing press, for example, a sheet-fed printing press or a reel-fed printing press, comprises on the input side a feeder device 01 which supplies the printing press with a sheet or web-like printing material 02, at least one printing unit 03, through which the printing material 02 is printed in single- or multi-color on one or both sides, and a product delivery tray 04, to which printed products or intermediate products are delivered as stacks or continuously (see e.g. FIG. 1). In a preferred embodiment also shown in the figures, the printing press is configured as a printing press for securities printing, for example, for printing web-like printing material 02, e.g. a printing web, or preferably for printing material in sheet form 02, e.g. printing sheets 02. The feeding device 01 is hereby configured e.g. as sheet feeder 01, in which a stack of print printing sheets 02 to be fed and printed can be arranged. The printing unit 03 of the printing press configured e.g. as a securities printing press can in principle be configured as a printing unit 03 for any printing method, however, in a preferred embodiment is configured for at least one-sided printing according to the Orlof process (see below). The printing material is preferably configured as paper composed of fibres from textile, linen or hemp and/or preferably contains a watermark in the still unprinted condition. The printing press is thus preferably configured as a sheet-fed printing press for securities printing and e.g. configured to produce products or intermediate products, individual printed sheets, in particular securities paper sheets, such as e.g. sheets of bank notes from printing sheets 02.

The printing sheets 02 are stored as stacks in the feeding device 01 designed as a sheet feeder 01 from which they are individually grabbed by a gripper device 06, which e.g. comprises suction cups, and transported individually on a conveyor path 07, e.g. a conveyor system 07 preferably configured e.g. as a belt system 07, to an entry area into the printing unit 03. At the entry to the printing unit 03, the printing sheet 02 is transferred to a conveyor path 08 associated with the printing unit 03, e.g. to a conveyor system 08 associated with the printing unit 03, through which the printing sheet 02 passes one or more printing positions 11; 12; 13 along its transport path, before being transferred from this conveyor path 07 associated with the printing unit 03 to a third conveyor path 09, e.g. a belt system by which it is transported to the product delivery 04, e.g. a product delivery 04 comprising one or a plurality of sheet trays for forming stacks.

The conveyor path 08 (see e.g. FIG. 3) associated with the printing unit 03 is preferably configured as a gripper system 08, in which the printing sheet 02 is transported by the printing unit 03 along the transport path through the printing unit (03) via successive transfers over a plurality of drums 14; 16; 17; 18 and/or cylinders 19, 44, that are consecutively arranged in the transport direction, for example, each also referred to and/or acting as transfer cylinder 14; 16; 17; 18; 19; 44. To this end, the drums 14; 16; 17; 18 and/or cylinders 19; 44 involved in transport have gripper devices in the circumferential area. For example, at the entrance into the conveyor path 08 of the printing unit 03, a drum 14 configured as a sheet feeding drum 14 is provided with gripper devices not explicitly shown here. In the interface between the conveyor path 07 and the sheet feeding drum 14, a so-called oscillating system 29 may be provided, the movement of which supports a register-true positioning against the sheet feeding drum 14. Depending on the design of the printing unit 03, one or a plurality of rotational bodies 18; 16; configured as transfer drums 18; 16; 17 and at least one cylinder 19; 44 involved in forming a printing position 11; 12; 13 and capable of transporting sheets of at least one printing unit 26; 27; 28 is (are) provided in the transport path through the printing unit 03 for transporting the printing sheet 02. At the end of the conveyor path 08 that is configured as a gripper system 08, the printing sheet 02 is transferred to the third conveyor path 09.

The printing unit 03 comprises at least a first printing unit 26 designed as an Orlof printing unit 26. The printing unit is preferably arranged on the side of the printing material 02 in the transport path of the printing material 02, which, in the finished product, for example the securities, forms the front side ("recto"). On the side of the transport path on which the printing sheet 02 is printed, the Orlof printing unit 26 comprises a first cylinder 21, which is also referred to as transfer cylinder 21, e.g. also as transfer cylinder 21 or as rubber cylinder 21 (see e.g. FIG. 3). The Orlof printing unit 26 thereby works according the offset procedure and can thus also be referred to as Orlof offset printing unit 26. This transfer cylinder 21 carries a successive number of printing blankets 15 in circumferential direction, for example, according to the number of its segments (in this case three). It acts on the printing material 02 with e.g. the cylinder 19, e.g. impression cylinder 19, that is involved in transport and acts as thrust bearing for the transfer cylinder 21. The impression cylinder 19 can serve the transfer cylinder 21 as an uninked printing cylinder acting only as thrust bearing or also as likewise ink-bearing cylinder 19 of a second printing unit 27 that interacts with the first printing unit 26 as a double printing unit 26, 27. In the first case, the transfer cylinder 21 and impression cylinder 19 form a single printing position 12, and in the second case, e.g. depicted here, they form a double printing position 12, 13 (see e.g. FIG. 3).

In principle, the aforementioned transport of the printing sheet 02 can be performed from the sheet feeding drum 14 via e.g. one or a plurality of transfer cylinders 16; 44 to one of the two cylinders 19; 21 (44) forming the printing position 12 (11). The number of transfer cylinders 16; 44 provided in the transport path is determined, among other factors, by the operational rotational directions of the sheet feeding drum 14 and of the receiving cylinder 19; 21 (44). The respective cylinder 19; 21 (44) then comprises transport means on the circumference, e.g. gripper devices. In a particular advantageous embodiment shown here the transport occurs on the cylinder 19 forming the impression cylinder 19 for the Orlof offset printing unit 26, which then preferably comprises the transport means, e.g. the gripper devices.

The discharge of the printing sheets 02 printed in the printing position 12 can in principle occur from any of the two cylinders 19; 21 (44) forming the printing position 12 (11) via e.g. one or more transfer cylinders 16; 44. However, in order to avoid a further transfer and arrangement of corresponding transport means on both cylinders 19; 21 (44), the discharge is preferably performed by the cylinder 19; 21 (44) onto which transfer is made at the input side of the printing position 12. Here, too, the number of transfer cylinders 17; 18 provided in the transport path downstream of the printing position 12 is determined, among other factors, by the operational rotational direction of the discharging cylinder 19; 21 (44) and by the transport direction of a conveyor means 122 receiving the printed printing sheets 02 in the conveyor path 09, e.g. a conveyor means 122 running via a deflection wheel 123, e.g. a sprocket wheel 123 in the area of the transfer point. The transport means 122 designed for example as chain 122 thereby comprises e.g. gripper devices that correspondingly open and close in the transfer area. Preferably at least two such conveying means 122 are provided next to each other. In the manner outlined—e.g. in connection with a separation shown below—and in a particularly advantageous embodiment the discharge is performed from the direction of the cylinder 19 that forms the impression cylinder for the Orlof offset printing unit 26 via preferably two transfer cylinders 17; 18 downstream of the printing position 12 in the transport path. Two optical inspection systems can be directed onto the shell of the two transfer cylinders 17; 18 in each of the rotating circumferential sections indicated but not specified in FIG. 2. These may be configured as camera systems with associated evaluation and/or display means and may, for example, monitor the print images with regard to quality characteristics.

Upstream of the transfer cylinder 21—where the term upstream or downstream in the printing unit 26; 27 (28) refers to the direction of the effective ink flow of the printing ink from the direction of the ink feed to the printing position 12; 13—the transfer cylinder interacts in print-on or thrown-on position with a second cylinder 22, e.g. a forme- or plate cylinder 22, in the following also referred to as Orlof plate cylinder 22, which bears on its surface the subject of a multi-colored complete picture. The subject can preferably be provided on one or more printing forms that are removably arranged on the perimeter or optionally provided directly on the shell. The Orlof plate cylinder 22 is preferably designed as a single circumference—or single segment cylinder, i.e. when viewed in circumferential direction it bears only one printing section and/or one printing form. This Orlof plate cylinder 22 interacts upstream in print-on or in relative thrown-on position with a third cylinder 23, e.g. referred to or implemented as blanket cylinder 23 or in particular as a collecting- or ink collecting cylinder 23. The ink collecting cylinder 23 is preferably designed as triple circumferential or triple segment cylinder, i.e. when viewed along the circumferential direction it bears three segments of print section lengths. The ink collecting cylinder 23 has, for example, an elastic and/or compressible surface. The ink collecting cylinder 23, transfer cylinder 21 and impression cylinder 19 are oriented in print-on position with respect to their rotation axes R23; R21; R19 in an essentially identical, preferably horizontal plane, at least, however—as regards e.g. a potential minor deviation not exceeding a maximum of 10 mm distance between the third plane with respect to the connecting axis between the two other rotational axes R19; 21; R22.

Several fourth cylinders 24 designed as stencil cylinders 24 interact upstream with the ink collecting cylinder 23 in print-on thrown-on position. The stencil cylinders 24 each successively ink areas of the ink collecting cylinder 23 with ink, or, in the case of iris prints, with an ink combination. They bear areas with relief contours of the print image section on their surface that correspond to the ink or ink combination (iris print). This sectional relief contour can preferably be provided on one or more printing forms removably arranged on the perimeter in the form of a relief or optionally be provided directly on the shell. From this ink collecting cylinder 24 that was multi-inked in this manner, the subject or multi-inked complete picture provided that is downstream on the Orlof plate cylinder 22 is multi-inked.

The stencil cylinders 24 on their part are inked upstream by at least one inking unit roller 32 each, e.g. inking roller 32, of the respective inking unit 31.

The inking unit 31 is preferably configured as a discontinuously inking doctor type inking unit 31, which facilitates reliable metering and printing even with the smallest quantities of ink, such as with securities printing. It comprises on the upstream end at least one ink source 33, e.g. an ink fountain 33, or a chambered doctor blade unit 33, from which printing ink can be applied to a first inking unit roller 34, e.g. a ductor roller 34 or ink fountain roller 34. A second pivotably-mounted inking unit roller 36, e.g. a ductor roller 36, is provided downstream of the fountain roller 34, which pivots during operation between the fountain roller 34 and a subsequent downstream third inking unit roller 37 with a hard surface (e.g. at least 60 Shore A), also referred to as naked cylinder 37. Downstream of the naked cylinder 37 in the direction of the associated stencil cylinder 24 follows a single draw pull-in roller or a pull-in roller 41, which can optionally be at least partially divided into several parallel roller trains, with additional rollers, which comprises, for example, at least one, preferably several ink unit rollers 38 with hard surfaces (e.g. at least 60 Shore A) and/or axially changeable configured, e.g. inking unit rollers 38, and at the end near the forme cylinders several inking unit rollers 32, e.g. inking rollers 32 that interact with the stencil cylinder 24. An inking unit roller 39, ink transfer roller 39 with a soft surface (e.g., maximum 50 Shore A) can be provided between the ink unit rollers 37; 38 having a hard surface.

In the preferred embodiments presented here, some or all of the inking units 31 are configured to provide two ink sources 33 for parallel inking in the inking unit 31, where the inking from the respective ink source 33 is performed at a downstream position by a fountain roller 34 and a fountain roller 36 on to a joint inking unit roller 37; 38; 39, in particular on the same naked roller 37. This parallel inking enables two-color printing by one inking unit, whereby two colors can be printed axially next to each other or blended together (the so-called "iris print"). To produce the desired axial color profile the two fountain rollers 36 of the same inking unit 31 are designed as "cut", i.e. they each have sections in axial direction with profiled shells with raised and recessed, strip-shaped circumferential sections.

Figure 3:
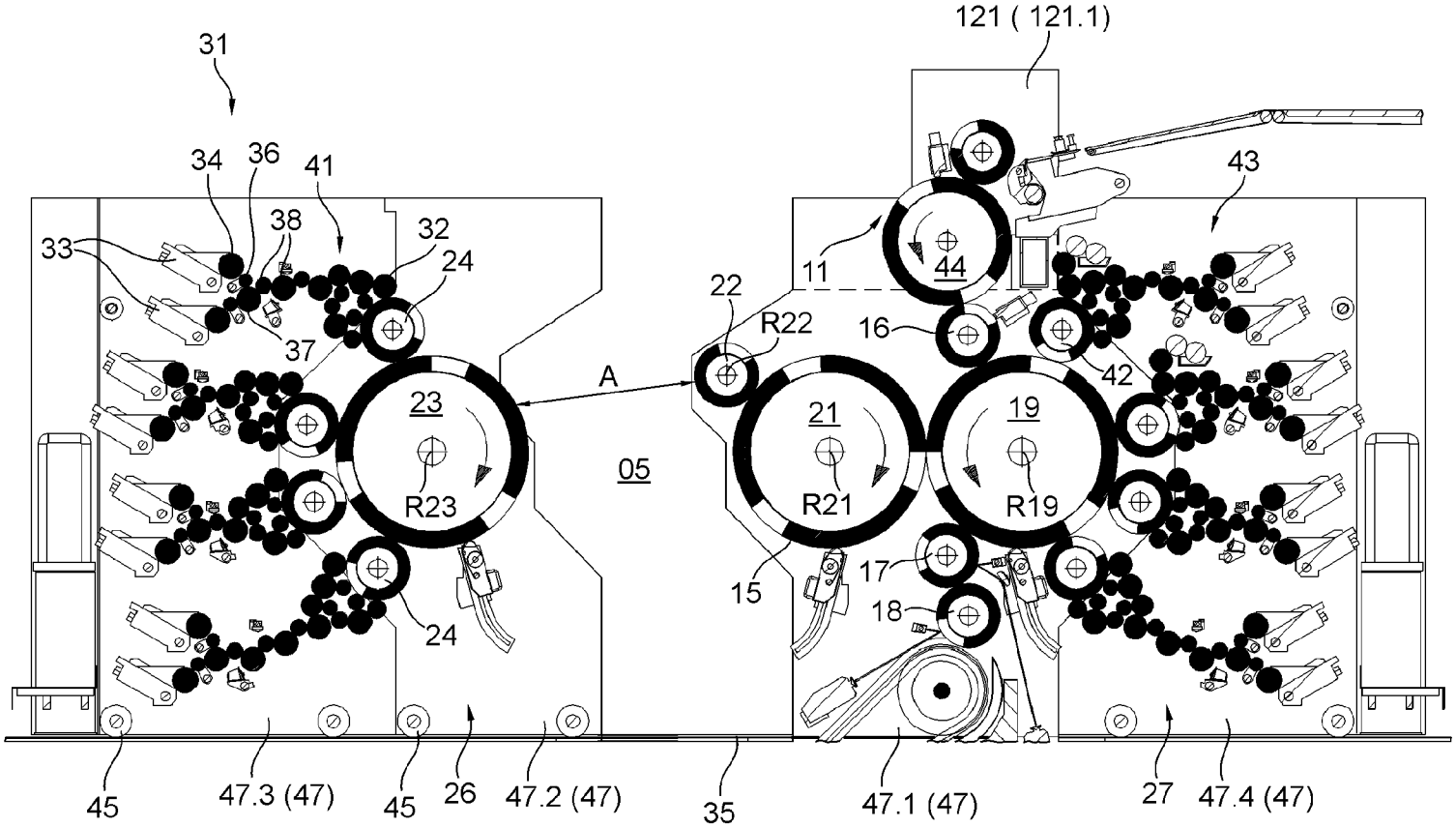
FIG. 3 the printing unit in a maintenance position of FIG. 2 in a first embodiment.

In the example shown, the printing unit 26 designed as an Orlof printing unit 26 forms a double printing unit 26, 27 together with the second printing unit 27, where the impression cylinder 19 of the Orlof printing unit 26 at the same time represents a cylinder 19 involved in the formation of the double printing position 12, 13 of the second printing unit 27 (see e.g. FIG. 3). Said printer unit 27 is preferably arranged on the side of the printing material 02 in the transport path of the printing material 02, which, in the finished product, for example the securities, forms the back side ("verso"). The second printing unit 27 can in principle be variably configured, e.g. for an indirect or direct gravure printing, an indirect or direct relief printing or an indirect or direct flat printing. In the example shown, it is configured as printing unit 27 for the indirect relief printing, where the cylinder 19 generating the double printing position 12, 13 on sheets of the second printing unit 27 is also configured as a transfer cylinder 19, e.g. also referred to as transfer cylinder 19, or blanket cylinder 19. This transfer cylinder interacts upstream in print-on position with several cylinders 42 configured as forme- or plate cylinders 42, which each bear on their surfaces the subject of a colour separation of a color, or color combination (iris print) of the complete image. This subject can be removably arranged on the perimeter of one or a plurality of printing forms e.g. in the form of surface- or relief printing forms or be optionally provided directly on the shell as a pattern. The respective forme cylinder 42 interacts for its inking with its associated inking unit 43 which, for example, can be implemented according to the aforementioned inking unit 31 of the first inking unit 26.

The exemplary printing unit 03 shown further comprises an additional printing unit 28 upstream in the printing material flow—in particular on the same side of the transport path as the Orlof printing unit 26—by which the printing material 02 can be one- or multi-color printed at a printing position 11, e.g. at a single printing position 11. The additional printing unit 28 is arranged vertically above the Orlof plate cylinder 22, i.e. it overlaps at least in its horizontal width between the print position 11 and ink fountain with the Orlof plate cylinder 22. The printing position 11 is, for example, formed by means of a cylinder 44 acting as impression cylinder 44 and comprising a conveying system for sheet travel and an additional cylinder 105 of the printing unit 28 designed, for example, as offset printing unit 28. Thus, within the above sense, the impression cylinder 44 is thereby configured as a transfer cylinder 44. Vice versa, a transfer cylinder 44 arranged in the transport path between the entry into the conveyor path 08 facing the unit and the printing position 12 forming the main printing position 12 simultaneously forms the impression cylinder 44 of the additional printing unit 28. The cylinder 105 forming the printing position 11 together with the cylinder 44 is, for example, configured as transfer cylinder 105 and interacts upstream with one or with a plurality of forme- or plate cylinders 115, which in turn is (are) inked with one or more (iris print) inks by each of one respective inking unit 119, for example, also a ductor type inking unit 119.

The machine frame 47 of the printing unit 03 may in principle be designed as a single piece, i.e. comprising one front-side continuous frame 47, or as described, also be preferably multi-pieced, i.e. several frames 47 per front-side that are separate or separable from each other 47.1; 47.2; 47.3; 47.4, e.g. sectional frames 47.1; 47.2; 47.3; 47.4. The term "separable" or also "dividable" is hereby to be understood as not merely a minor thrown-off in an otherwise maintained working position, and also not as a disassembly in the sense of a dismantling, but as an operational movement away into a maintenance (relative) position for maintenance and/or set up purposes.

The transfer cylinder 21 and the ink collecting cylinder 23 are thereby mounted in different printing unit sections and/or in sectional frames 47.1; 47.2 that are different from each other. The Orlof plate cylinder 22 can in principle be added to one or the other of the two printing unit sections and/or to sectional frames 47.1; 47.2 that are different from each other. Advantageously, the impression cylinder 19 and the transfer cylinder 21 are part of the same first printing unit section and/or mounted in a same first sectional frame 47.1, e.g. a preferably stationary main frame 47.1 that is arranged in the printing press. However, in order to achieve an as fault-free as possible image transfer from the Orlof plate cylinder 22 to the transfer cylinder 21, at least the Orlof plate cylinder 22 and the transfer cylinder 21 interacting with the Orlof plate cylinder 22 and preferably optionally also the impression cylinder 19, are preferably part of a first printing unit section and/or mounted in a first sectional frame 47.1, e.g. a preferably stationary main frame 47.1 that is arranged in the printing press. The majority of stencil cylinders 24 and ink collecting cylinders 23 are part of a second printing unit section and/or mounted in a second sectional frame 47.2. The first and the second sectional frame 47.1; 47.2 are selectively moveable toward each other into a first, a working-position forming relative position, and into a second, maintenance position-forming relative position, where in maintenance position a space 05 between the first and second printing unit section and/or sectional frames 47.1; 47.2 supporting these is formed, which provides—for example, an operator—direct access to the ink collecting cylinder 23, to the Orlof plate cylinder 22 and to the transfer cylinder 21 interacting with the Orlof plate cylinder 22 (see e.g. FIG. 3).

Figure 2:
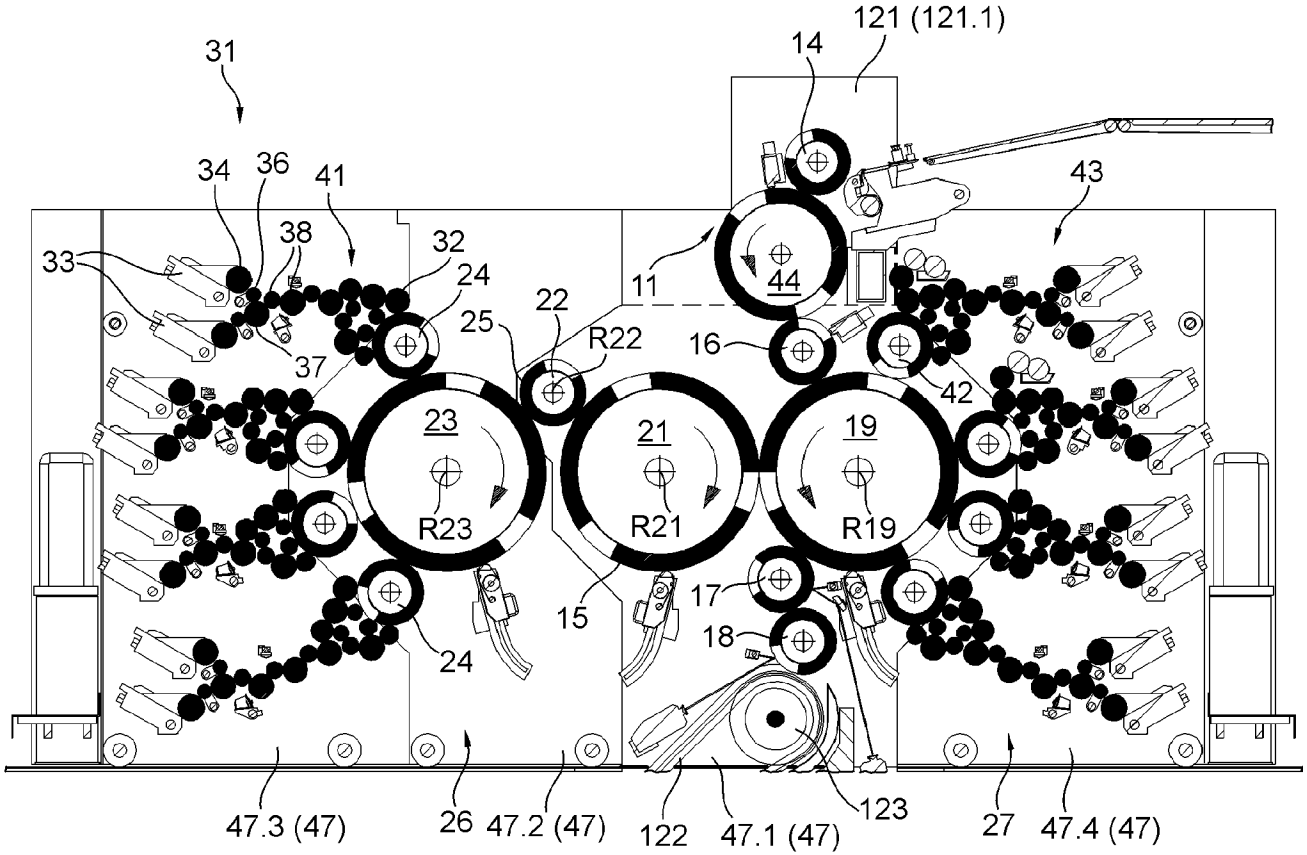
FIG. 2 an exemplary embodiment of a printing unit in a work position in a first embodiment.

The sheet feeding drum 14 and at least one of the transfer cylinders 44; 16 that follow in the transport path, in particular the next following transfer cylinder 44, are, for example, included in the first sectional frame 47.1 in an upper frame part 121.1 in the sense of a frame section, or in a specially provided frame part 121; 121.1 in the form of a frame insert or attachment 121; 121.1 that is tightly but removably connected with the first sectional frame 47.1 (see e.g. FIG. 2 and FIG. 3).

In the embodiment with the aforementioned additional printing unit 28, at least the inking unit(s) 119 and optionally the form cylinder(s) 115 to be inked by the inking unit(s) 119 of the additional printing unit 28 can be included in and/or on the second sectional frame 47.2 in an upper frame part 121; 121.3; 121.2, 121.3 in the sense of a frame section and/or mounted in and/or on a multi-component frame insert or -attachment 121; 121.3; 121.2, 121.3 (see FIG. 4 to FIG. 7 below).

Although for the aforementioned relative movement, both sectional frames 47.1; 47.2 or the first sectional frame 47.1 could in principle be movably arranged in the printing press, the second sectional frame 47.2 is preferably moveably configured relative to the first sectional frame 47.1. To this end, the second sectional frame 47.2 is translationally moveably mounted along a movement path, for example via roller bodies along a travel, preferably via rollers 45 on a corresponding guide track 35, in the direction of the first sectional frame 47.1 or moveably mounted in a direction away from it.

For example, means not shown are provided through which the two sectional frames 47.1; 47.2 can be connected or coupled with each other in working position. In the working position, the second sectional frame 47.2 is in thrown-off position and/or disconnected from the first sectional frame 47.1. For coupling, a mechanical lock is advantageously provided which is, or can be, remotely opened and closed by at least one actuator.

In the working position, the ink collecting cylinder 23 and the Orlof plate cylinder 22 are arranged relative to each other in an operating position, i.e. in an operational thrown-on or thrown-off position, whereby, for example, in operational thrown-off position a distance a between the effecting shell surfaces of the ink collecting cylinder 23 and Orlof plate cylinder 22 lie, for example, in the single-digit millimeter range (i.e. for example 0<a<10 mm) and/or a switch between thrown-on and thrown-off position occurs without relative movement of the sectional frames 47.1; 47.2. In contrast, in maintenance position the shell surfaces are spaced apart from each other at a radial distance A, which is significantly greater, e.g. at least by a factor of 10, preferably by more than a factor of 100, than the distance in thrown-off position (i.e. for example A>100*a and/or A≥100 mm, in particular A≥100 mm). A switch between working—and maintenance position is performed with and/or by a relative movement of the two sectional frames 47.1; 47.2.

In principle, the inking units 31 can also be part of the second printing unit section and/or be mounted in the second sectional frame 47.2 and be moved along therein. For maintenance purposes, the inking units 31 are however preferably part of a third printing unit section and/or are mounted in a third sectional frame 47.3. The second and third sectional frame 47.2; 47.3 are positionally variable relative to each other. Preferably, they are also selectively moveable with respect to each other into a first relative position forming a working position, and into a second relative position forming a maintenance position, where in maintenance position, a space (not shown here) between the second and third printing unit section and/or sectional frames 47.2; 47.3 supporting them is formed. The third sectional frame 47.3 is, for example, also translatorically moveably mounted along a movement path, for example by roller bodies on a travel, preferably also via rollers 45 on a corresponding, e.g. identical or on an extension of a guiding 35, in the direction of the second sectional frame 47.2 or mounted in a direction moveable therefrom and is also referred to as inking carriage. Here too the aforementioned lock between both sectional frames 47.2; 47.3 is preferably provided in their working position.

Figure 4:
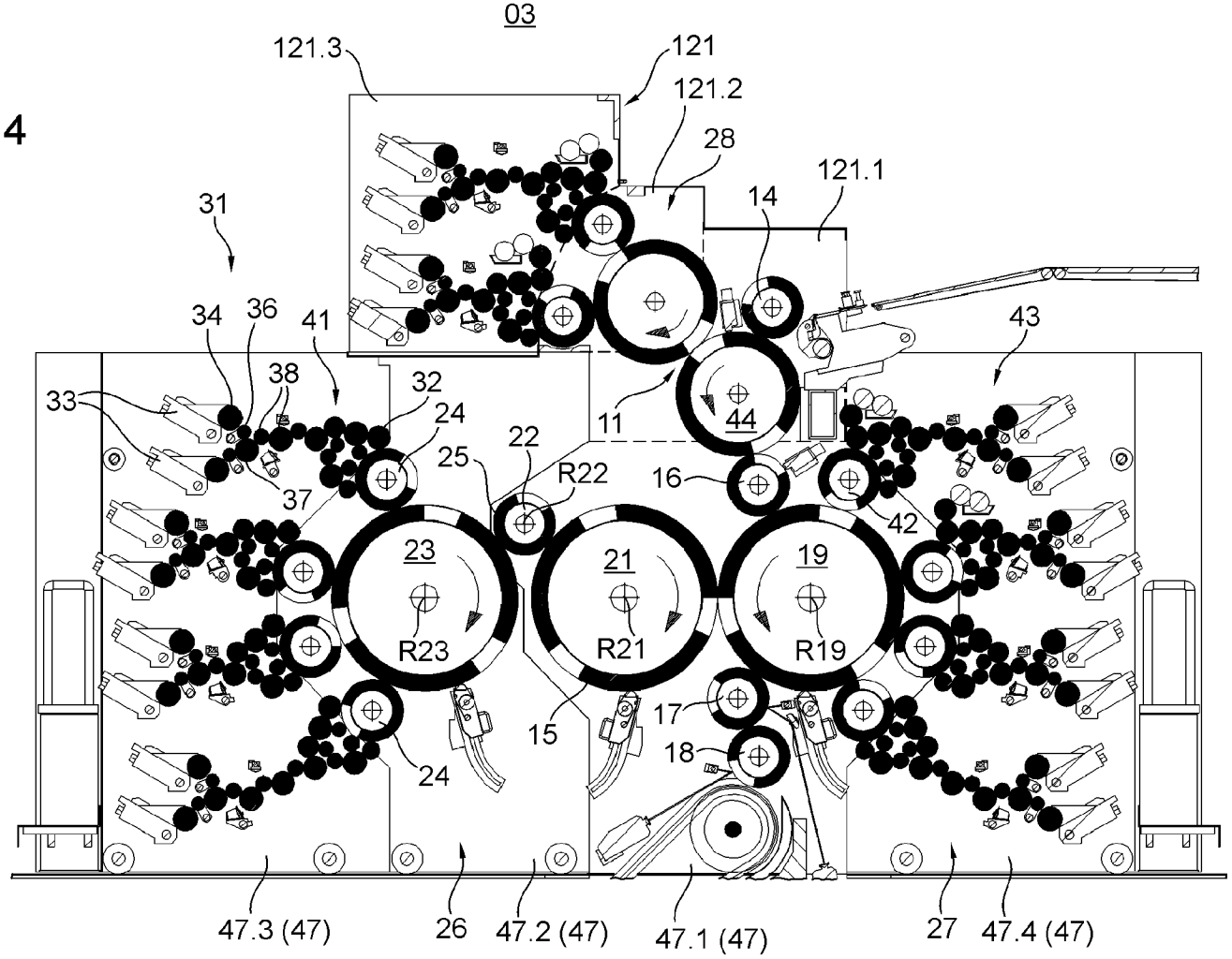
FIG. 4 an embodiment of a printing unit in a work position in a first embodiment.
Figure 5:
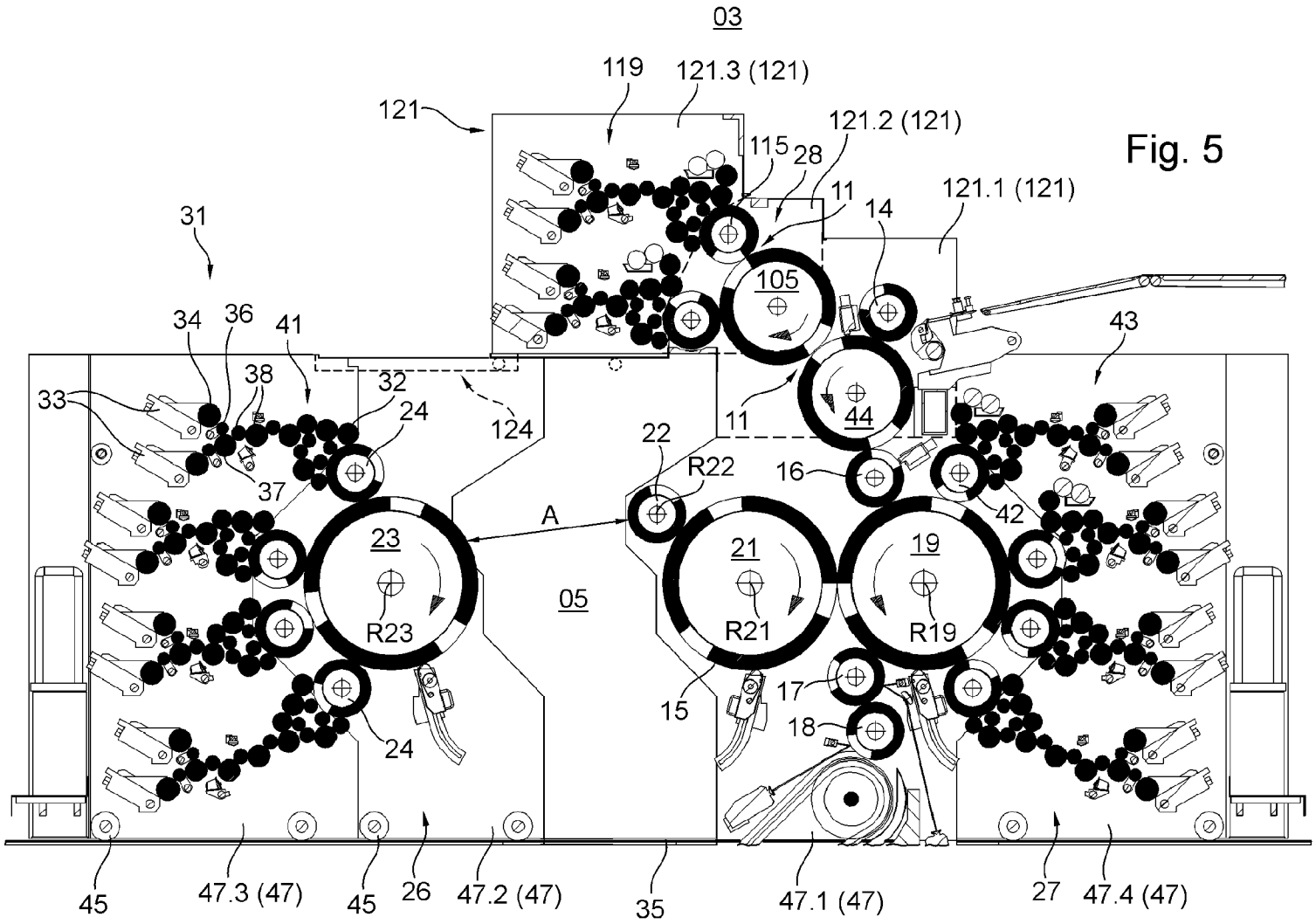
FIG. 5 the printing unit in a maintenance position of the first embodiment of FIG. 4 in a first variant embodiment.

In a first variant embodiment of the embodiment of the unit 03, in which in working position the aforementioned additional printing unit 28 is provided above the Orlof plate cylinder 22, at least the ink-conducting cylinders 105; 115 and the first or second inking unit(s) 119 of the additional printing unit 28 are provided in the sectional frame 47.1 of the first printing unit section or in a frame part 121 fixedly connected to the sectional frame 47.1, e.g. a one- or multi-piece frame attachment 121 (121.1, 121.2, 121.3) (see e.g. FIG. 4). In multi-piece embodiments, respective frame parts 121.1, 121.2, 121.3 can be firmly connected with each other, but are disconnectable for installation purposes. The frame 121 or frame attachment 121 can in principle be arranged in or on a higher-level machine frame (not shown in FIG. 3, however, for example, indicated in FIG. 1) and/or on the first sectional frame 47.1 and can optionally be further supported on the second sectional frame 47.2 that is moveably arranged beneath it. In the event that this one- or multi-piece frame piece 121 or frame attachment 121 is supported on the movable sectional frame 47.2 beneath it, it may, for example, be arranged so as to be moveable in horizontal direction on the sectional frame 47.2 via a linear guiding 124 (see e.g. FIG. 5). The guiding 124 can be configured as sliding bearing- or roller bearings-based linear guiding. The sheet feeding drum 14 and the end of the sheet unit facing the printing unit may also be provided in such frame piece 121.

Figure 6:
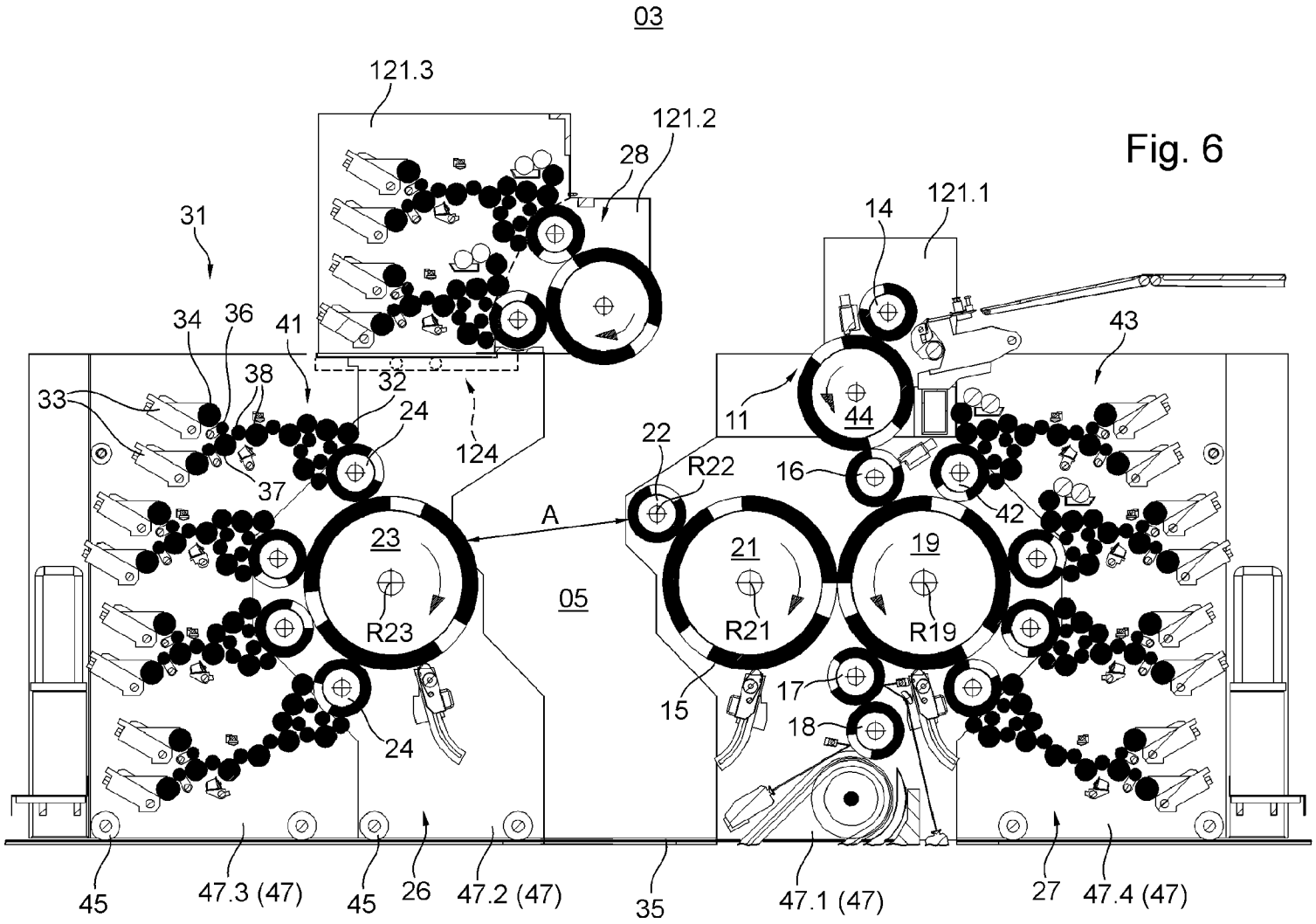
FIG. 6 the printing unit in a maintenance position of the first embodiment of FIG. 4 in a first alternative of the second variant embodiment.
Figure 7:
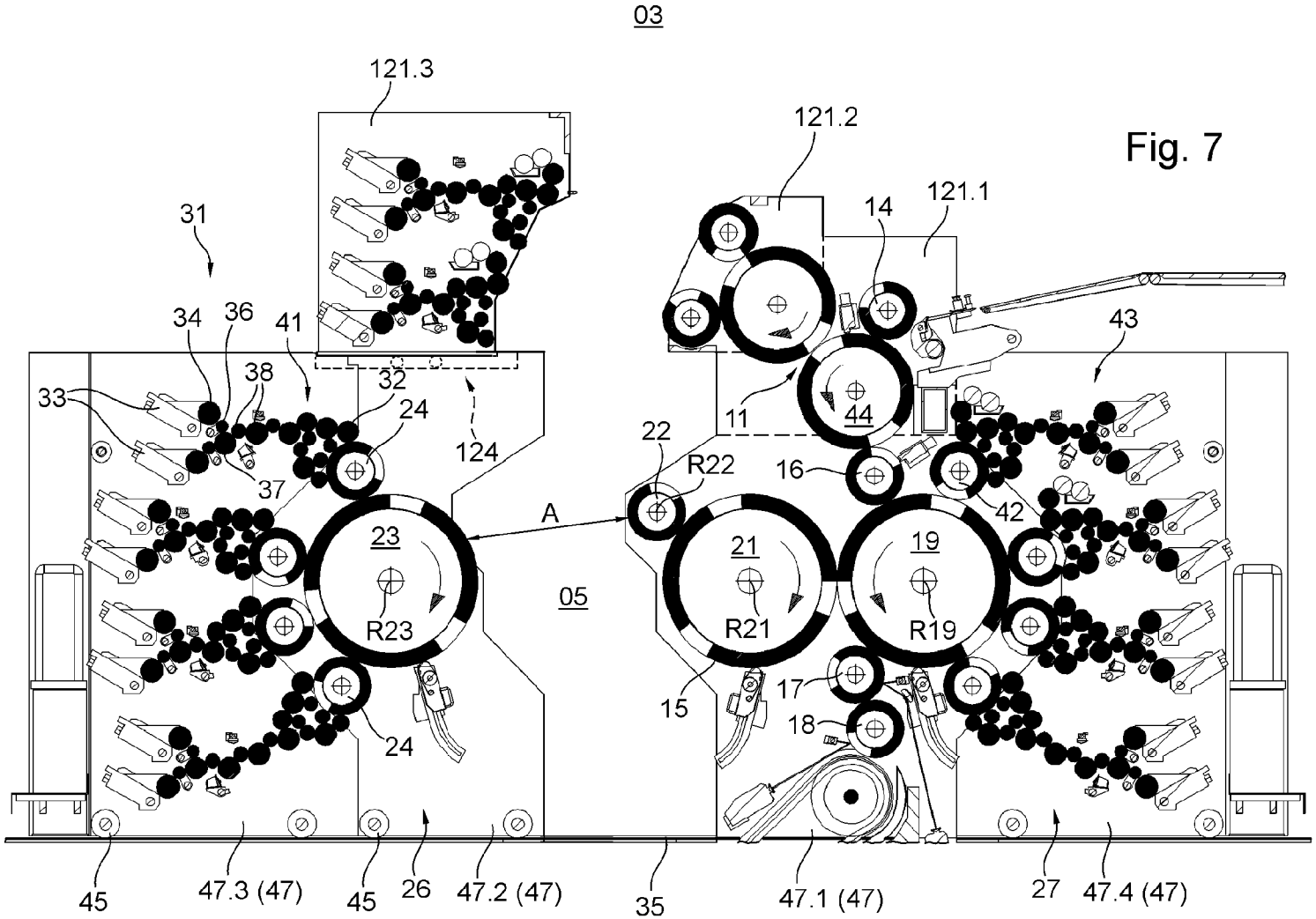
FIG. 7 the printing unit in a maintenance position of the first embodiment of FIG. 4 in a second alternative of the second variant embodiment.

In a further development shown in FIG. 6 and FIG. 7 with also improved accessibility to the additional printing unit 28, the additional printing unit 28—e.g. together with the Orlof printing unit 26—can be configured to be separable, wherein "separable" in the above sense is to be understood as not merely a throw-off in an operational position, and also not as disassembly, but as an operational movement away for maintenance- and/or loading purposes.

In a first alternative, this additional printing unit 28 can in principle be separably configured in the region of its printing position 11. The respective parts of the additional printing unit 28 can be correspondingly separated in the sectional frame 47.1; 47.2 of the first and second printing unit section, or mounted in a single- or multiple piece sectional frame attachment 121.1; 121.2, 121.3 connected thereto. In this alternative embodiment, a modular equipping or re-equipping of a unit 03, as for example shown in FIG. 2 and FIG. 3 above, can be performed without having to substantially change or exchange the upper frame part 121.1 (in the sense of a frame section or as a frame attachment 121.1, in particular partial frame attachment 121.1) of the first sectional frame 47.1 other than part of the body that may potentially have to be removed. The printing unit components that interact with the impression cylinder 44 and all upstream printing unit components, including the forme cylinder(s) 115 and the inking unit(s) 119, are then mounted in an upper frame section or preferably in a one- or multi-piece frame attachment 121.2; 121.3 of the second sectional frame 47.2.

In a second, preferred alternative (see e.g. FIG. 7), the additional printing unit 28 is, for example, operationally separable between the inking unit(s) 119 and cylinders 115 interacting with the downstream inking unit(s) 119. Here too, the respective components of the additional printing unit 28 can be correspondingly separated in the sectional frame 47.1; 47.2 of the first and second printing unit section, or mounted in a one- or multiple piece sectional frame attachment 121.1; 121.2, 121.3 each connected thereto. The at least one inking unit 119 can then be mounted in an upper frame part 121.3 of the second sectional frame 47.2 or in a sectional frame attachment 121.3 that is firmly connected to the latter. The at least one forme cylinder and an optionally provided transfer cylinder 105 is or are arranged in an upper frame section of the first sectional frame 47.1 or in a one- or multi-piece sectional frame attachment 121.1, 121.2 firmly connected to the latter. The impression cylinder 44 can be mounted in the upper frame section of the first sectional frame 47.1 or also in a one- or multi-piece sectional frame attachment 121.1, 121.2 firmly connected to the latter. In a further development that is advantageous with respect to modularity, the at least one forme cylinder 115 and the optionally provided transfer cylinder 105 can be mounted in a sectional frame attachment 121.1 that is different from the sectional frame attachment 121.1 that carries the impression cylinder 44, but is firmly but detachably attached thereto. The sectional frame attachment 121.2, or the sectional frame attachment 12.2 connected thereto, that carries the at least one forme cylinder and the optionally provided transfer cylinder 105 is then to be removed from the upper frame section of the first sectional frame 47.1 that carries the impression cylinder 44 and optionally the sheet feeding drum 14 or, when needed, such sectional frame attachment 12.2. is to be added. Instead of or in addition thereto, the frame section 121.1 carrying the impression cylinder 44 and optionally the sheet feeding drum 14 may also be configured as sectional frame attachment 12.1; 121.1, 121.2 that is removably connected with the first sectional frame 47.1. The one- or multi-piece sectional frame attachment 12.1; 121.1, 121.2 connected to the first sectional frame 47.1 and carrying the at least one forme cylinder and the impression cylinder 44 and the optionally provided transfer cylinder 105, is then e.g. exchangable as a whole with a sectional frame attachment 12.1 which is used only to transport print material, as shown in FIG. 2 and FIG. 3.

In a different further development of this second alternative, the sectional frame attachment 121.3 can instead or in addition thereto be arranged and/or mounted on or with the second sectional frame 47.2 such that in operation mode it is moveable along a guide 124 in a direction towards and can be moved away from the sectional frame attachment 121.1; 121.1, 121.2 that carries the forme cylinder 115. This facilitates maintenance or loading of the additional printing unit 28 without having to move the printing unit 26 arranged below the latter into the maintenance position.

In an advantageous variant of the aforementioned first alternative embodiment from FIG. 6, the frame attachment 121.2; 121.3 on the sectional frame 47.2 can be separably configured in two pieces and arranged between the at least one inking unit 119 and the at least one forme cylinder 115 in the above sense for loading purposes. The at least one inking unit 119 is thereby mounted in a sectional frame attachment 121.3, which can be pivotably removed or e.g. moved away in the form of a inking carriage on a guide 124 from a sectional frame attachment 121.2 which is firmly connected to the second sectional frame 47.2 and can accommodate the at least one printing unit cylinder 115; 105 to be inked.

In the context of the operationally separable alternatives and variants of the embodiments shown in FIG. 6 and FIG. 7, e.g. means are also provided (not shown) by which the two one- or multiple-piece sectional frame attachments 121.1; 121.2; 121.3 can be connected or coupled at their separation points in the working position. In the working position, the one- or multi-piece sectional frame attachment 121.3; 121.3, 121.2 carrying the at least one inking unit 119 is in thrown-off position and/or disconnected from the sectional frame attachment 121.1; 121.1, 121.2 connected to the first sectional frame 47.1. A mechanical lock is advantageously provided for coupling, which is or can be remotely operated by at least one actuator in order to open and close. Preferably, in the uncoupled or disconnected state, the additional printing unit 28 with the Orolf printing unit 26 is then separably configured at the respective separation point. In the uncoupled state, particularly locked state, the two sectional frame attachments are then brought, together e.g. with the first and second sectional frame 47.1; 47.2, from a first relative position, i.e. a working position into a second relative position, i.e. a maintenance position, in which they are further spaced apart from each other and also form an accessible space between each other. If a guide 124 is additionally provided according to the description relating to FIG. 5, in the coupled state of the sectional frame attachments 121.1; 121.2; 121.3, i.e. when the additional printing unit 28 is locked, the printing unit 26 arranged below can be separated for maintenance and loading purposes.

In an advantageous embodiment, a logic is provided in a control device, such as a software control and/or a control circuitry, which is configured such that it allows a relative movement of the second sectional frame 47.2 relative to the first sectional frame 47.1 only in the connected state, e.g. locked, with the third sectional frame 47.3, and/or a relative movement of the third sectional frame 347.3 relative to the second sectional frame 47.2 when in the coupled state, e.g. with a closed lock, between the first and second side frame 47.1; 47.2.

In an advantageous further development, a logic is implemented or provided in a control device, for example in a software control and/or a control circuitry of the press, which is configured such that it permits the start and/or operation of the press only when the sectional frames 47.1; 47.2; 47.3 or printing unit sections are in the working position and/or with a closed lock between the first and second, and, in the case of a third separable printing unit section, between the second and the third sectional frame 47.1; 47.2; 47.3. Sensors, which are in signal connection with the aforementioned control device can be provided to monitor the working position and/or the state of the lock in an advantageous manner.

During the switch of a printing form 25 to the Orlof plate cylinder 22 during standstill of the printing press, the lock between the first and second sectional frame 47.1; 47.2 is first released, in particular by means of a remotely-operated actuator by the machine control system or a control routine implemented therein, and/or triggered at an operator interface connected thereto, e.g. a control station. When the lock is released, the relative position of the first and the second sectional frame 47.1; 47.2 are brought from the working position into the maintenance position, for example by activation of a drive via, for example, a corresponding control routine, in which they are further spaced apart from each other and form the space 05 that can be accessed by operating personnel. This is preferably accomplished by moving the second sectional frame 47.2 while the first sectional frame 47.1 is stationary. The already unloaded Orlof plate cylinder 22 which, in a further operational step, is liberated from any printing form 25 over the space 05 from a previous, last production is then loaded with at least one printing form for the next production. After loading, the first and the second sectional frame 47.1; 47.2—by activation of the same or another drive via the control routine—are brought from the maintenance position back into the working position relative to each other, the lock between the first and second sectional frame 47.1; 47.2 is re-established, and finally the press is started via a machine control, for example triggered by a command from the operator interface. The start, however is effected by the machine-control dependently of a signal state of a sensor that monitors the working position of the sectional frames 47.1; 47.2, in particular of the second sectional frame 47.2, and/or the state of the lock, or is interrupted in the event of a negative monitoring result of the working position and/or lock.

If the Orlof offset printing unit 26 is interactingly arranged in the printing unit 03 together with a second printing unit 27 in form of a double printing unit 26, 27, on the other side of the printing material 02 transport path or on the other side of the first or main frame 47.1, at least one additional, e.g. fourth printing unit section and/or a fourth frame 47.4, e.g. a sectional frame 47.4, containing the fourth printing unit section can be provided. This is, for example, in the aforementioned manner regarding the second or the third sectional frame 47.2; 47.3 preferably lockably mounted in the direction of the first sectional frame 47.1 and can be moved away therefrom. In the present case of a second printing unit 27 configured for relief printing, the fourth printing unit section contained in the fourth sectional frame 47.4 can comprise the inking units 43 of the second printing unit 27, which, in working position of the fourth printing unit section or sectional frame 47.4 interact with the forme cylinders 42, e.g. mounted in the main frame 47.1.

The third and fourth sectional frame 47.3; 47.4 can be implemented in the same structural manner—with the exception of only minor differences and the vertical mirror-image arrangement—in particular as regards the implementation and/or arrangement of the mounting. The arrangement and the implementation of the mounting of the cylinders 24; 42, e.g. stencil cylinders 24 on the one hand and forme cylinder 24 on the other, which each interact with the inking units 31; 43 and are arranged in the first sectional frame 47.2; 47.1 may be provided in the same manner in or on the respective sectional frame 47.2; 47.1—with the exception of only minor differences and a mirror-image arrangement.

In the first printing unit 26, in particular configured as an Orlof printing unit 26, the second cylinder 22 configured as a forme cylinder 22 is arranged in or on the one- or multi-piece frame 47 (47.1) of the printing unit 03 by means of a bearing arrangement such that it can selectively moved as the middle cylinder 22 e.g. in print-on position into a thrown-on position, in particular into a double or two-sided thrown-on position, in which it is thrown on to the first cylinder 21 which is configured as transfer cylinder 21 and on the third cylinder 23 configured as ink collecting cylinder 23 (see e.g. FIG. 7*a*), or e.g. in print-off position into a thrown-off position, in which it is thrown-off from at least one of the two cylinders 21; 23, preferably also from the upstream as well as downstream cylinder 21; 23 (see e.g. FIG. 7*b*). In thrown-off position, the distances a; b between the effective shell surfaces of the interacting cylinders 23; 22; 21 can be adjusted to lie in the same size range mentioned above with respect to the distance a between the ink collecting- and Orlof plate cylinders 23; 22 in print-off position, or also within different size ranges and/or within the respective range. In thrown-off position, the ink transfer from the upstream third cylinder to the downstream first cylinder 23; is therefore interrupted at least at one position, and continuous in thrown-on position.

At least one of the two cylinders 21; 23 interacting with the second or middle cylinder 22, preferably the downstream cylinder 21 involved with the formation of the print position 12; and for example configured as a transfer cylinder 21, is radially adjustable via a correspondingly configured bearing arrangement 48 with respect to its rotational axis (see e.g. FIG. 3 and FIG. 4). It is, for example, adjustably configured with respect to its distance to the other cylinder 19, in particular impression cylinder 19, which forms the print position 12; 13 together with the first cylinder 19 in thrown-on position. The other of the two cylinders 23; 21 adjacent to the forme cylinder 22, e.g. the upstream ink collecting cylinder 23, is mounted with respect to its rotational axis e.g. operationally stationary in the printing unit 01, but can optionally be radially adjustably arranged outside of operation, e.g. during the start up procedure or maintenance.

The bearing arrangement 46 of the middle cylinder 22, in particular configured as forme cylinder 22, preferably as Orlof plate cylinder 22, is now configured such that the cylinder 22 or its rotational axis R22 is moveable by two superimposable movements along two movement paths, i.e. within a vertical plane with respect to the rotational axis R22 with two degrees of freedom. In principle, this can be performed by superimposition of two movements along any non-congruent movement paths, e.g. by superposition of two linear movements along two non-parallel running straight lines, advantageously however in a same, preferably vertical plane with respect to the rotational axis R22, or by the superposition of two pivot movements about two pivot axes S1; S2 spaced apart from each other, preferable, however running parallel towards each other and preferably also parallel with respect to the axis of rotation R22, or also by a mixed form of one of the aforementioned linear movement and a pivot movement.

The movement of the cylinder 22 or its rotational axis R22 within the two degrees of freedom occurs by adjustment of a first and second control element 49; 51, which can in principle be implemented as a linearly-movable fixture or pivotable lever. In a preferred embodiment, the adjusting elements 49; 51 are however formed as shown by pivotable eccentric rings 49; 51 of a, for example, multi-ring bearing 52, e.g. a four-ring bearing 52, configured as a multiple eccentric bearing 52, (see e.g. FIG. 4 and FIG. 5). The bearing arrangement 46 thereby comprises the multi-ring bearing 52 and its attachment in or on the frame 47 (see e.g. FIG. 5). A first, inner eccentric ring 49 encloses an inner ring 56, for example, via bearing means 53, e.g. a radial bearing 53 that accommodates a cone 54 of the cylinder 22 and is in turn surrounded, for example via bearing means 57, e.g. radial bearing 57, by the second, outer eccentric ring 51. This in turn is accommodated, for example, via bearing means 58, in an outer ring 59 of the multi-ring bearing 52, and the latter accommodated in a drill hole in the frame 47 and optionally non-rotatably fixed. In a known manner, the eccentric rings 49; 51 are hereby rotatable mounted against each other and against the outer ring 59, whereby, by a superposition of the curve paths effected by the eccentricities e1; e2, a two-dimensional radial positioning of the rotational axis R22 is facilitated at least within a limited larger setting range greater than zero within a plane running vertical with respect to the rotational axis R22.

The radial setting or movement of the first cylinder 21 configured as a transfer cylinder 21, or its rotational axis R21, in radial direction can be performed by setting of only one adjusting element 61, which can in principle be configured as a linearly moveable mount or as a pivotable lever (see e.g. FIG. 4). In a preferred embodiment, the adjusting element 61 (shown in FIG. 6 partially covered by an adjusting disc 55) is formed by a pivotable eccentric ring of a multi-ring bearing e.g. a three-ring bearing that is configured e.g. as an eccentric bearing. The bearing arrangement 48 therefore comprises the multi-ring bearing not shown in detail as well as its connection in or on the one- or multi-piece frame 47 of the printing unit 03. An inner eccentric ring (not shown) thereby encloses a radial bearing that, via bearing means, accommodates the cone 62 of the cylinder 21, and is in turn accommodated, for example via bearing means, in an outer ring of the multi-ring bearing, and the latter is accommodated in a drill hole of the frame 47 and optionally non-rotatably fixed. The eccentric ring is thereby rotatable in a known manner against the outer ring, whereby the eccentricity (not shown in the figure) enables a radial positioning of the rotational axis R21 along a curved path which runs in a vertical plane with respect to the rotational axis R21.

For the two-dimensional setting of the second cylinder 22, a drive mechanism acts on the two adjusting elements 49; 51 to effect their movement. The drive mechanism comprises at least one adjusting member 63; 64, e.g. an adjusting drive 63; 64, which acts directly or indirectly on the adjusting element 49; 51. This or these can in principle be variably configured, e.g. as a motor, but preferably implemented as a pressure actuatable actuator 63; 64, in particular as pneumatic cylinder 63; 64 or optionally as a hydraulic cylinder 63; 64, (see e.g. FIG. 4). The respective adjusting members 63; 64 may in principle act directly on the eccentric ring 49;

51, but preferably act via a gearing 66; 67, e.g. a one- or multiple lever gearing 66; 67, on, for example, a tab 78; 79 that is connected to the respective eccentric ring 49; 51. In the example, the respective gearing 66; 67 comprises a two-armed lever, which is pivotable about a pivot axis S68; S69. The two-armed lever is formed e.g. by two rotationally fixed lever arms that are located on the same shaft 68; 69, whereby, as synchronous shaft, the respective shaft 68; can connect two drive mechanisms for two front-side bearing arrangements of the cylinder 22. In the example, the output-facing lever arm is not directly connected to the eccentric ring 49; 51 or to the eccentric ring-fixed tab 78; 79, but via a rocker 85; 95.

In principle, the adjusting member 63; 64 itself and/or the gearing 66; 67 can be controllable or at least adjustable with respect to its travel, and may therefore make a travel limit for the adjustment movement unnecessary (see e.g. below to FIG. 9).

In a first advantageous embodiment, the adjustment movement of the cylinder 22 or the adjusting elements 49; 51 at least in thrown-on direction, i.e. in the direction of the respective thrown-on position, however occurs in each case against a limit stop 71; 72 that limits the travel. This limit stop 71; 72 can be interactingly arranged in the region of the adjusting element 63; 64 itself, in the gearing 66; 67 or with the adjusting element 49; 51, i.e. the eccentric ring 49, 51, or with a counterstop 73; connected to the adjusting element 49; 51. In a preferred embodiment, the respective limit stop 71; 72 is hereby configured as an eccentric ring-fixed counterstop 73; 74, e.g. a stroke surface 73; 74 of a tab 76; 77 or nose 76; 77 that is firmly connected to the respective eccentric ring 49; 51. The respective drive mechanism, e.g. the output-facing side of the gearing 66; 67, can act directly on the respective eccentric ring 49; 51, on the tab 76; 77 surrounding the counter stop surface 73; 74, or for spatial design reasons on another tab 78; 79, spaced apart in circumferential direction with respect to the eccentric ring 49; 51 by more than 90°. The tabs 76; 77; 78; 79 in the embodiment shown are connected to adjusting discs 65; 75 or adjusting rings 65; 75 that are firmly connected to the eccentric rings 49; 51 that overlay the eccentric rings 49; 51 in the figure (see e.g. FIG. 4).

When the first and second adjusting members 63; 64 are actuated in a direction each effecting thrown-on r1; r2, the associated eccentric ring 49; 51 is then rotated, e.g. via the respective gearing 66; 67 until its counter stop surface 73; 74 strikes the limit stop surface of the associated limit stop 71; 72. The position of the first and second eccentricity e1; e2 is selected such that the second cylinder 22 is thereby thrown on the first cylinder 21 and on the third cylinder 23. The end position, i.e. the thrown-on position, is defined by the position of the limit stop 71; 72 viewed from the circumferential direction of the eccentric ring 49; 51. This position of the limit stops 71; 72 can be used to adjustably set the thrown-on position, i.e. the contact pressure between the cylinders 19; 22; 23 (see below). In order to limit the force upon the limit stops 71; 72 exerted by each adjusting member 63; 64 and/or also to ensure during adjustment of the respective limit stops 71; 72 the stroke with the counterstroke 73; 74 in print-on or thrown-on position, the gearing 66; 67 can be elastically configured with respect to a force transmission, at least as far as the force in the direction of the thrown-on position is concerned. The gearing 66; 67 can be elastically configured in a manner so that when the eccentric-fixed limit stop 73; 74 engages with the limit stop 71; 72 with a travel of the actuator 63; 64 which is greater than a travel required for engagement of the limit stops 71; 72; 73; 74, at least a slight deflection of the gearing 66; 67 occurs. To this end, a pivot axis S68; S69 or an input or output-facing joint of the lever or a joint of the pivot arm 85; 95 can be moveably mounted against a spring force in or on the co-acting lever arm or on the co-acting coupling.

The three cylinders 21; 22; 23 configured as e.g. as transfer cylinder 21, as forme cylinder 22 and as ink collecting cylinder 23 are thus mounted in such a manner in the one- or multi-pieced frame 47 that the most downstream of the three cylinders 21 is moveably mounted with respect to its distance from the additional cylinder 19, which is designed e.g. as impression cylinder 19, and that the middle of the three cylinders 22 is adjustable with respect both to its distance from the downstream adjacent cylinder 21 as well with respect to its distance from the upstream adjacent cylinder 23, that is e.g. operationally stationary fixed, in particular in a position that allows it to be thrown-on or thrown-off.

If now the radial position of the first cylinder 21, in particular configured as transfer cylinder 21, in changed in such a way that its distance to the second cylinder 22 that is in thrown-on position is changed, the resulting pressure in thrown-on position deviates from the desired pressure. By the solution outlined in the following it is now possible to essentially maintain a constant distance, i.e. within a tolerance range, with respect to the distance of the rotational axes R21; R22; R23 of the first of the three in serially arranged cylinders 22, and thus the pressure between the three cylinders even with a radial positional change, and in particular even during the positional change.

A forced tracking of the middle of the three cylinders 21; 22; 23 is thereby provided in such a manner that a radial movement of the downstream adjacent cylinder 21, which is e.g. configured as a transfer cylinder 21, by a travel greater than zero within its operational positional range forces a setting of the two adjusting elements 49; 51 that position the middle cylinder 22 with respect to two radial directions by a defined travel that is greater than zero. The forced setting is of such extent and arranged so that a distance between the rotational axis R22 of the middle cylinder 22 that is in thrown-on position with the upstream and downstream cylinder 23; 21 with respect to the rotational axis R23 of the upstream cylinder 23 as well its distance to the rotational axis of the downstream cylinder 21 remains essentially constant during a positional change of the downstream cylinder 21 within its operational setting range, i.e. during e.g. setting within the operational range by less than a fiftieth, in particular less than a hundredth, the radius of the middle cylinder 07 varies (see e.g. FIG. 6 and FIG. 7). In FIG. 6 and FIG. 7 the drive mechanism in FIG. 4 for thrown-on and thrown-off was for the sake of clarity not shown, but merely indicated by a dashed line. Thereby parts of the drive mechanism for throw-on and throw-off and for the tracking can act on the same tab 78 and, depending on the view, may at least partially obscure each other.

The forced setting during tracking of the adjusting elements 49; 51 during positioning of the middle of the three cylinders 22 may optionally be accomplished by a corresponding drive control of the adjusting drives 63; 64, provided they are controllably configured with respect to their positioning within their travel. Preferably, the positioning coupled with the movement of the first cylinder 21 occurs by a forced positional change of at least one of the adjustment elements 49; 51, preferably of both adjustment elements 49; 51, that limit the movement of the limit stop 71; 72 for thrown-on position. This defines the thrown-on position of the second cylinder 22 with respect to the two adjacent cylinders 21; 23 as coupled with the position of the first cylinder 21, and is forced and changed in a defined way with a positional change of the first cylinder 21.

The forced positioning during tracking, i.e. repositioning, of the two adjustment elements 49; 51 that position the middle of the three cylinders 22 can be accomplished in a first embodiment by mechanical means, in particular by purely mechanical means (see e.g. FIG. 6 and FIG. 7).

For two-sided tracking of the second cylinder 22, i.e. of the two adjusting elements 49; 51, the limit stops 71; 72 that limit the throw-on position of the adjusting elements 49; 51 are moveably mounted and with respect to their movement mechanically coupled to the adjusting mechanism 48, 55; 61, 81 of the first cylinder 21, e.g. to the partially obscured adjusting element 61, e.g. the eccentric ring 61, or as shown, to the adjusting ring 55 or the adjusting disc 55, or to the drive mechanism 81 driving the adjusting element 61. The mechanical coupling can in principle be accomplished in parallel to the two stops 71; 72, or as shown in an advantageous embodiment in series first indirectly or directly with one of the two movable limit stops 71; 72 and from this via the movement of the associated adjusting element 49; 51 directly or indirectly with the other of the two limit stops 72; 71.

The drive for the first of the two stops 71 is driven by a first gearing 91, e.g. a lever gearing 91, that converts the adjusting movement of the first cylinder 21 or its adjusting drive into a movement of the first stroke 71. This is accomplished, for example, via a coupling 82, the one end of which engages with the adjusting element 61, e.g. eccentric ring 61, of the first cylinder 21, in particular with a tab 83 connected thereto via e.g. the adjusting ring 65, and engages on the output end with a lever 84 enclosing the limit stop 71. The lever 84 is pivotably mounted about a pivot axis S84 and encloses the limit stop 71 on a side facing the counterstop 73. This limit stop 71 is configured by a curve segment 88 on the side facing the counterstop 73 in such a way that a pivoting of the lever 84 effects a defined variation of a contact point between the limit stop 71 and eccentric ring-fixed counterstop 73 in the circumferential direction of the eccentric ring 49. The drive mechanism, the arrangement and configuration of the lever and the curve segment 88 is such that the positioning of the first cylinder 21 in a certain direction causes a defined positioning of the first adjusting element 49 in a certain direction, e.g. of the first eccentric ring 49, and therefore causes a defined first of the two movements of the cylinder 22 or its rotation axis R22 that are to be superimposed.

The drive of the second of the two limit stops 72, here serially-driven, occurs by the movement of the first adjusting member 49, i.e. the first eccentric ring 49, via a gearing 92 that transforms the rotational movement of the first eccentric ring 49 into a movement of the second limit stop 72. To this end, a coupling 86 hinged to the first eccentric ring 49 or to one of its tabs 76; 78 can directly or indirectly act on the second limit stop 51. In an advantageous embodiment, the coupling 86 that is outer-centrally connected with the first eccentric ring 49, e.g. with respect to its outer circumference, via a one- or multi-step gearing 92, e.g. one- or multi-step gearing lever 92, acts on a second lever 87 that surrounds the second limit stop 72. The lever 87 is pivotable about a pivot axis S87 via the coupling with the first eccentric ring 49 by rotation of the eccentric ring 49 and comprises the second limit stop 72 on a side facing the second counterstop 74. This limit stop 72 is also configured on the side facing the second counterstop 74 by a curve segment 89 in such a way that a pivot of the lever 87 again results in a defined variation of a contact point between the second limit stop 72 and eccentric ring-fixed counterstop 74 in circumferential direction of the eccentric ring 51. The drive mechanism, the arrangement and configuration of the second lever 87 and the curve segment 89 is such that the positioning of the first cylinder 21 in a certain direction via the movement of the first adjusting element 49 effects a defined positioning of the second adjusting element 51, e.g. of the second eccentric ring 51, in a certain direction, and thereby causes a defined second of the two movements of the cylinder 22 or its rotation axis R22 to be superimposed. In the lever gearing 92 here advantageously configured as two-step lever gearing, the coupling 86 that interacts the with second eccentric ring 51 acts on a lever 93 that is pivotable about a pivot axis S93. For pivotable mounting, the lever 93 can be arranged on any frame-fixed axle or shaft, but is here e.g. rotably moveably mounted on the already existing shaft 68. The lever 93 can in particular be configured as one- or optionally two-armed, but is preferably configured to transform the movement of the eccentric ring 51 in the area of the coupling into a larger movement of the output end. The output facing end of the lever 93 can engage either directly on the second lever 87 to effect its movement, but in an advantageous embodiment is hingingly connected here with the lever 87 via a rocker 94 (see e.g. FIG. 7).

In a particularly advantageous further development, the two drive mechanisms for the two-dimensional movement of the cylinder 22 with respect to the throw-on position are adjustable. To this end, at least one of the limit stops 71; 72, is here advantageously adjustably configured e.g. at least one the levers 84; 87 bearing the limit stops 71; 72, preferably both limit stops 71; 72 or levers 84; 87, with respect to a basic position of the contact point between the respective limit stop 71 and the associated eccentric ring-fixed counterstop 73 in the circumferential direction of the eccentric ring 49; 51. In principle, the pivot axis R84; R74 on the frame 47 could be configured to be movable in the radial direction. Here, the adjustability is however provided by the variability of the relative radial position between the lever 84; 87 and the associated pivot axis S84, S74. In the embodiment shown, this is provided by the lever 84; 87 being radially movable with respect to the frame-fixed pivot axis S84, S87 via a guide. For this pivotable mounting the lever 84; 87 comprises an effective recess 96; 97, e.g. a longitudinal hole 96, that acts as a guiding in which a frame-fixed limit stop 98; 99, e.g. a frame-fixed bearing limit stop roller 98; 99, is arranged in such a way that a guided relative movement having only one degree of freedom is possible in the longitudinal direction of the recess 96; 97. The axis of the limit stop roll 98; 99 thereby coincides with the effective pivot axis S84; S87 of the lever 84; 87. The limit stop rolls 98; 99 are not required to be rotatable, but can also be configured as a non-rotatable arranged limit stop discs 98; 99. The setting of the relative position between the limit stop 98; 99 and lever 84; 87 occurs for example by means of an adjusting disc 101; 102 with a helical varying outer circumference line, such as a screw 101; 102, the outer circumference of which interacts with a lever-fixed limit stop 103; 104. The screw 101; 102 is, for example, mounted on the axle bearing the limit stop roll or -disc 98; 99 and, in order to avoid friction, interacts with a lever-fixed limit stop 103; 104 configures as a roller 103; 104. The screw 101; 102 is directly or indirectly adjustable by a drive mechanism (not shown), such as a handwheel or a motor drive. By turning the adjusting disc 101; 102, the lever-fixed limit stop 103; 104 and thereby the lever is moved along the direction of its degree of freedom. The adjustment by the adjusting disc 101; 102 is hereby preferably performed against the force of a spring element 106; 107, e.g. a tension spring 106; 107, so that a strong contact between the adjusting disc 101; 102 and lever-fixed limit stop 103; 104 is ensured. Instead of the movable stroke surface on the adjusting disc 101; 102 acting as adjustment member and the pre-tensioning by spring force, a two-sided effective coupling between an adjustment member and the lever 84; 87 is in principle also conceivable.

Figure 8:
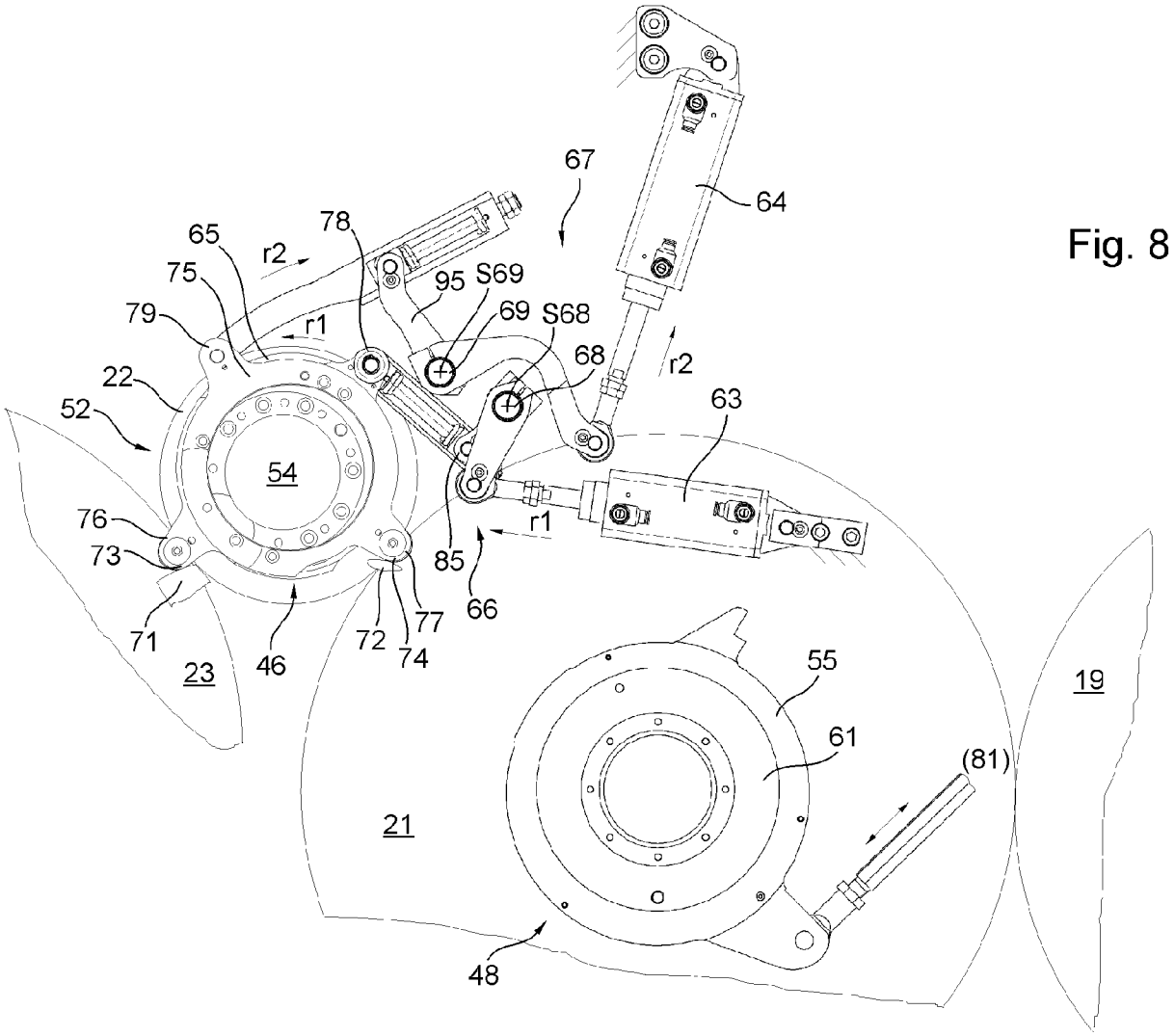
FIG. 8 an exemplary embodiment of a drive mechanism effecting the throw-on/throw-off.
Figure 9:
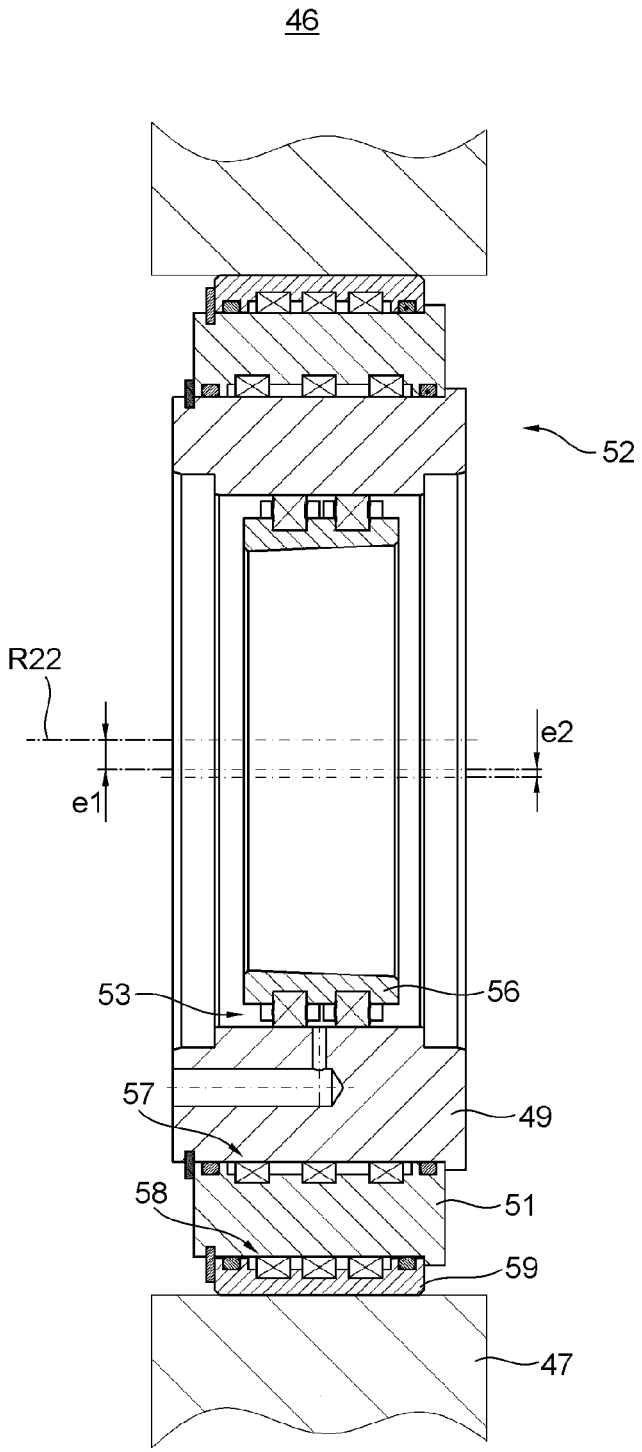
FIG. 9 a sectional view through a multi-eccentric bearing.
Figure 10:
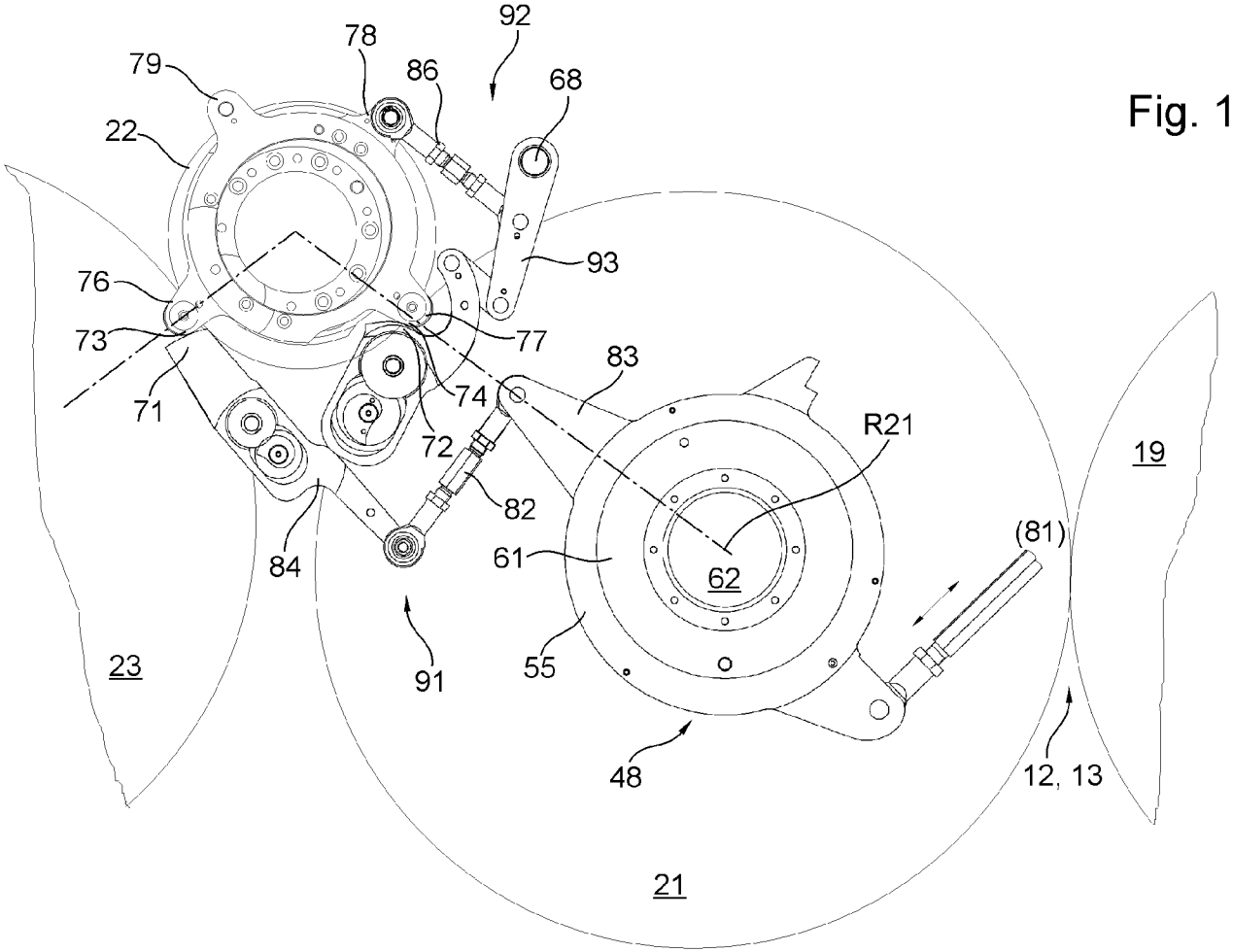
FIG. 10 a first embodiment of a drive mechanism effecting the two-sided tracking of a second cylinder with mechanical coupling to the movement of a first cylinder.
Figure 11:
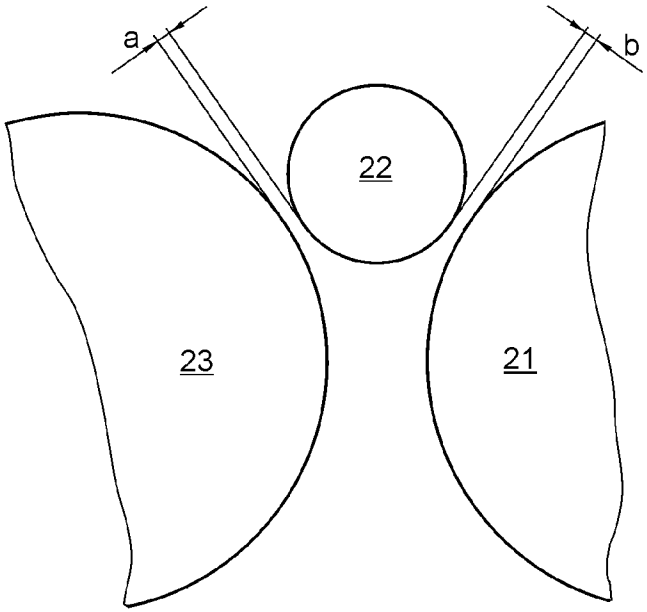
FIG. 11 a schematic representation of a) the Orlof plate cylinder arranged on each side in thrown-on position and b) the Orlof plate cylinder arranged on two sides in thrown-off position.
Figure 11:
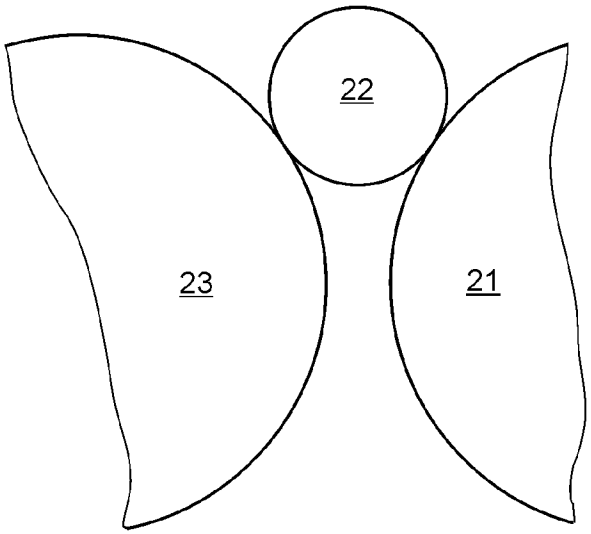
Figure 12:
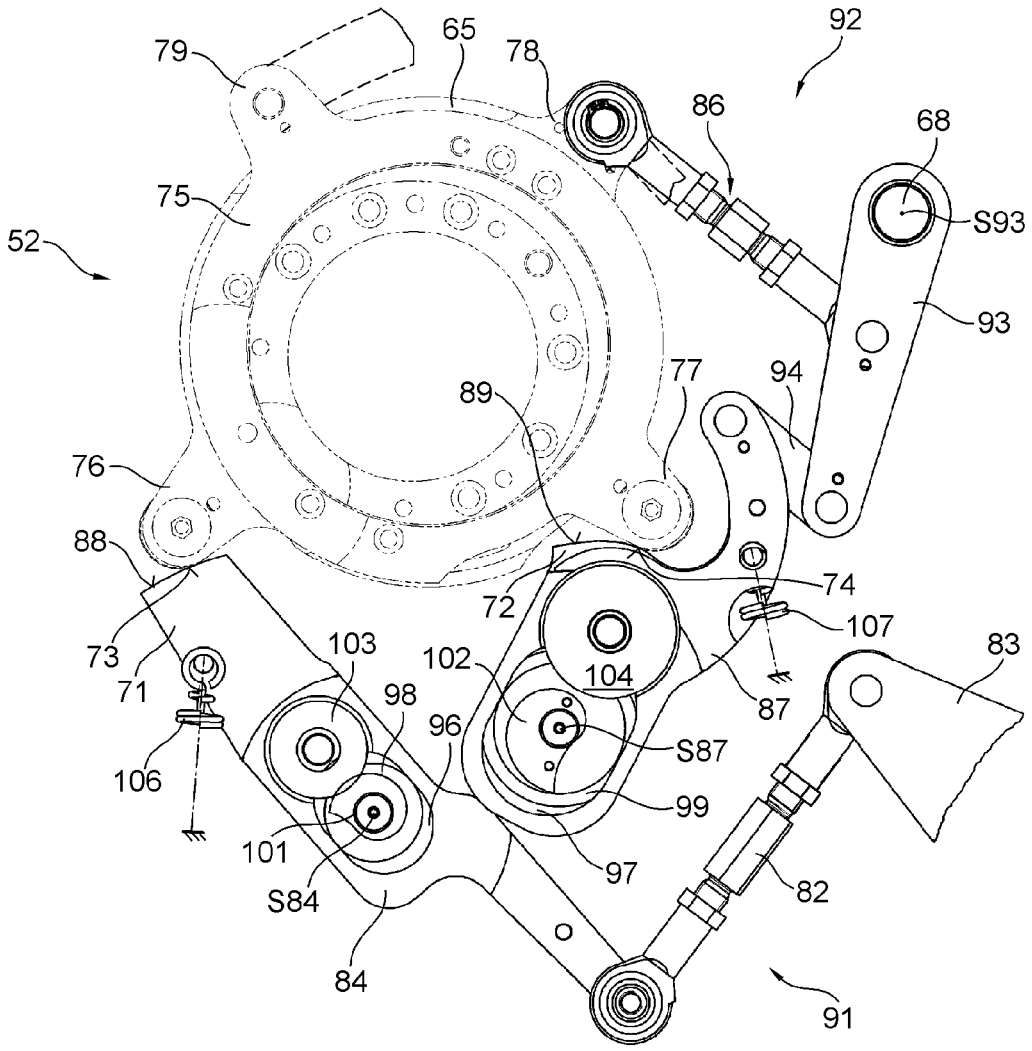
FIG. 12 an enlarged view according to FIG. 6.
Figure 13:
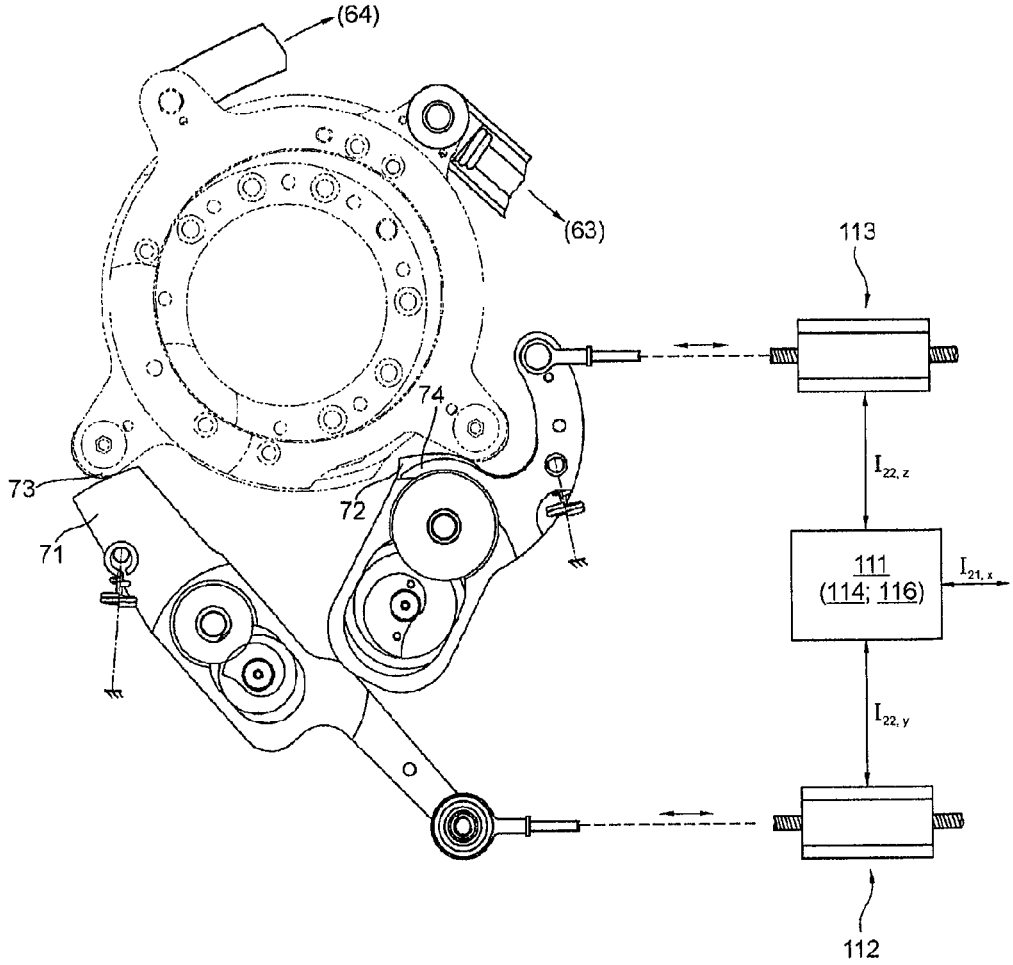
FIG. 13 a first variant of a second embodiment of a drive mechanism effecting the two-sided tracking with electronic and/or mechanical control coupling to the movement of a first cylinder.
Figure 14:
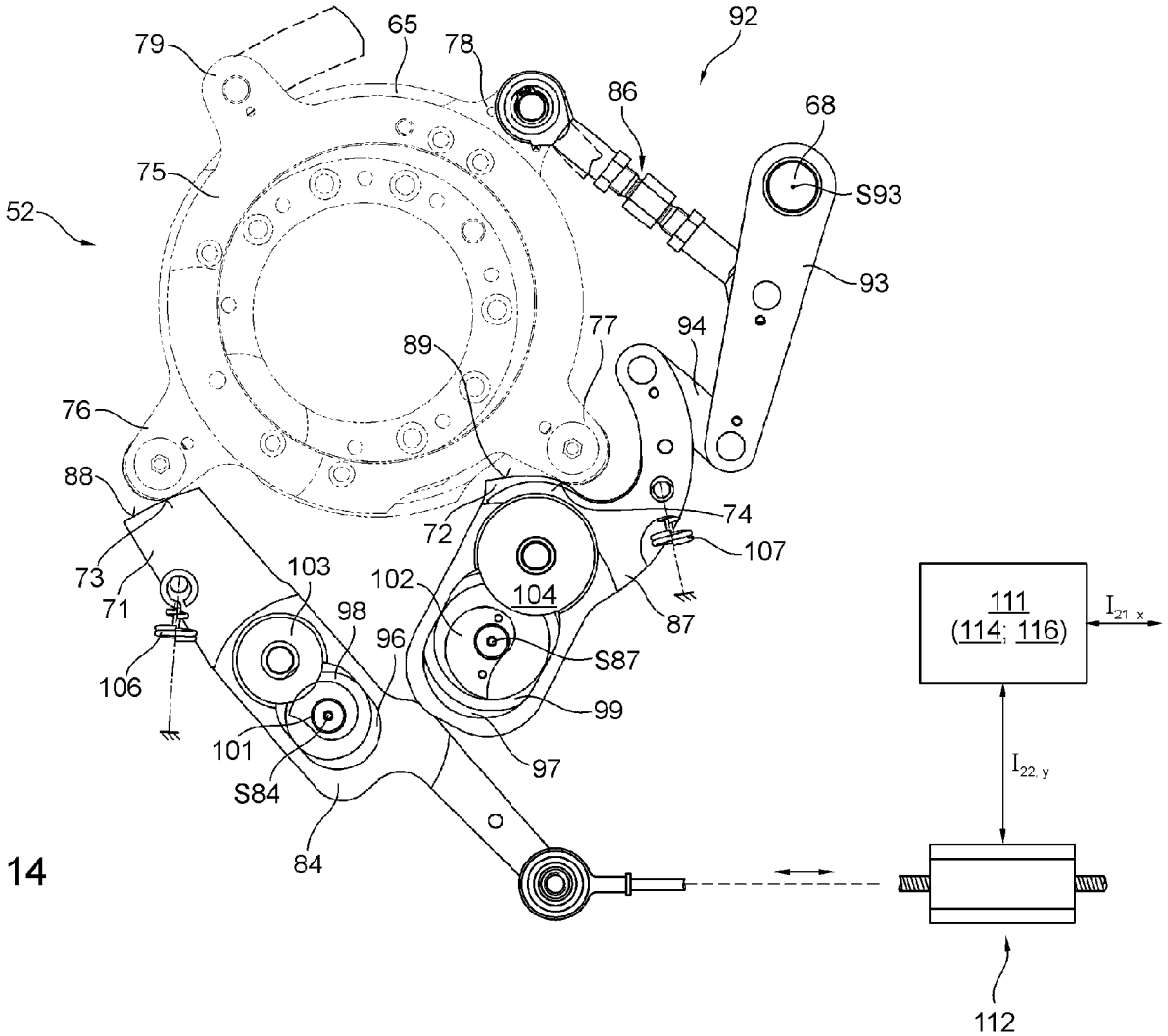
FIG. 14 an alternative of the first variant of the second embodiment for the drive mechanism effecting the two-sided tracking with electronic and/or mechanical control coupling.
Figure 15:
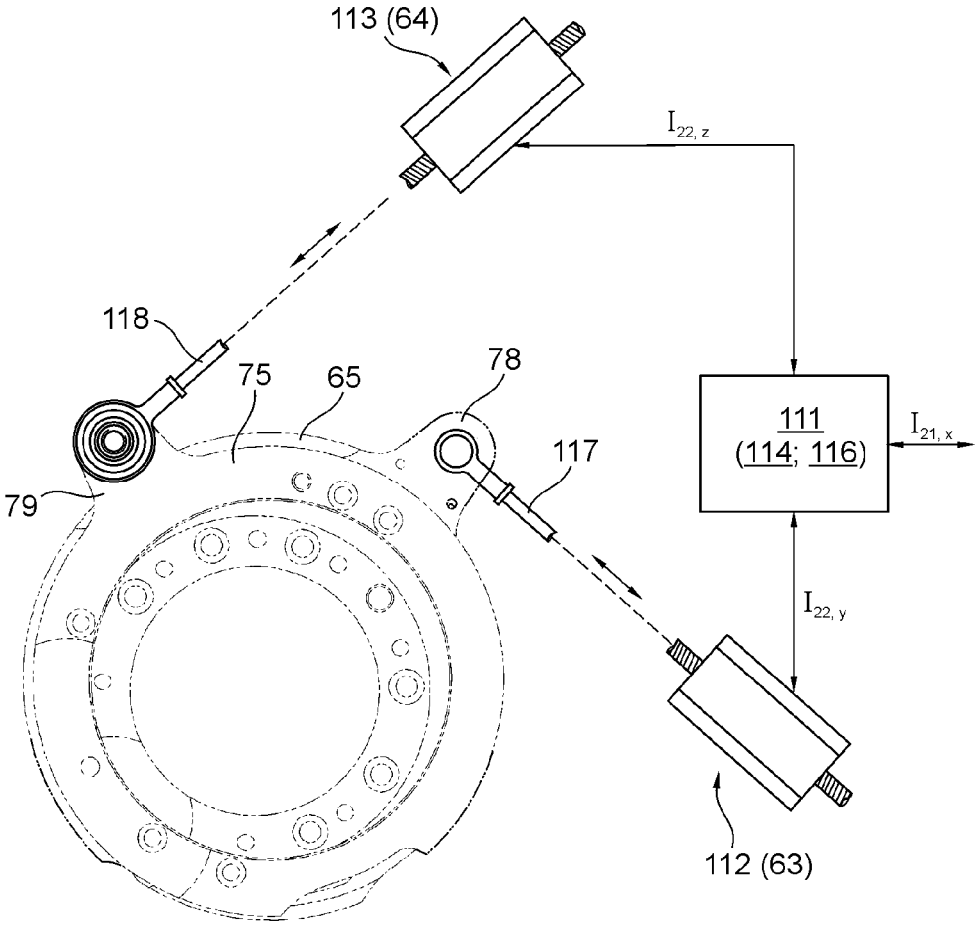
FIG. 15 a second variant of the second embodiment of a drive mechanism effecting the two-sided tracking with electronic and/or mechanical control coupling to the movement of a first cylinder.

In a second embodiment, the setting forced by the tracking of the two adjustment elements 49; 51 that position the middle of the three cylinders 22 can occur by mechanical means and/or control-technical means (see e.g. FIG. 8, FIG. 9 and FIG. 10).

The coupling between the adjusting movement of the first cylinder 21 and the tracking of the adjustment elements 49; 51 hereby occurs by electronic control means 111, for example, in an electronic circuit and/or software-based way, or is configured in this way. The adjusting means 111 acts on at least one adjusting drive 112; 113, which is provided to set the first and/or second adjusting element 49; 51 or to set the limiting stop 71; 72 that limits the thrown-on position of the first and/or second adjusting element 49; 51. The setting is performed using information and/or dimension $I_{21,x}$ that characterizes a position x and/or a positional change ΔX of the first cylinder 21 or its bearing device.

A circuit arrangement 114 and/or a software program 116 is provided in the control means 111, in which is implemented or stored information and/or dimension $I_{21,x}$ that characterises a clear association or relationship between the position x and/or a positional change Δx of the first cylinder 21 or its bearing device, and information $I_{22,y}$ that prescribes a target position y and/or a target positional change δy of the tracking of the second cylinder 22 along the first movement direction, and information $I_{22,z}$ that prescribes a target position z and/or a target position change δz along the second movement direction. For a majority of values that relate to the position x and/or positional change Δx of the first cylinder 21, the assignment can assign in tabular form target values for the target positions y; z and/or target positional changes δy; δz for the tracking along the two movement paths. In the embodiment with two adjusting drivers 112; 113 these represent, for example, triplet values. The assignment or the relationship can, however, also be realized by electronic—or software means as a continuously functional relationship—e.g. via analogue technology of a circuit or a function digitally implemented in a software routine.

In a first variation embodiment of the second embodiment (see e.g. FIG. 8) two adjustment members 63; 64, e.g. actuators 63; 64 to which force can be applied are provided for the throwing-on or throwing-off of the cylinder 22 that, as in the first exemplary embodiment and not explicitly shown in FIG. 8, act directly or indirectly on the adjusting elements 49; 51, whereas for tracking, two different adjusting drives 112; 113, e.g. adjusting motors 112; 113 are provided that are different therefrom. These adjusting motors 112; 113 act directly or indirectly on the limit stops 71; 72—the limit stops 71; 72 that limit the throw-on position for the adjusting elements 49; 51 according to the first embodiment—and are movably mounted. The information provided in the first exemplary embodiment regarding the implementation and effect of the limit stops 71; 72 is to be accordingly applied here. Here too, a respective setting of the limit stop 71; 72 can occur directly or indirectly via an appropriate gearing. In contrast to the first embodiment, however, mechanical coupling with the adjusting mechanism of the first cylinder 21 is not provided, but for each of the two adjusting elements 49; 51 that move the second cylinder 22 along a movement direction an individual adjusting drive 112; 113 is provided on the drive-facing side.

The drive mechanism comprising the adjusting drive 112; 113 and the coupling is hereby regulably- and/or controllably configured in a continuous way or using a number (e.g. >2, in particular >10) of small steps within a setting range greater than zero with respect to its position, and exhibits e.g. an appropriately large inner resistance or comprises an associated locking brake in order to secure the desired position. I.e. the adjusting drive 112; 113 can bring the position of the active limit stop 71; 72 into more than two defined positions that are different from each other. To this end, a drive motor that can be regulated as a stepper motor or relative to its position, or a control circuit with motor-external sensors can be provided.

If in this first alternative of the second embodiment the first cylinder 21 is radially set, e.g. in thrown-off (print-off) position from the impression cylinder 19, the implemented relationship effects a two-sided "tracking" of the second cylinder 21 that is correlated with the setting of the first cylinder 21, i.e. a correlated setting of the two limit stops 71; 72 of the cylinder 22.

In an alternative to the first variant embodiment of the second embodiment (see e.g. FIG. 9) only an adjusting drive 112 for tracking the two adjusting elements 49; 51 is provided, whereby the two adjusting elements 49; 51 can be coupled to the adjusting drive 112 in parallel, or serially, as in the first exemplary embodiment. In contrast to the first variant embodiment, the control means 111 acts on the joint drive for the first and second movement or on an adjusting drive 112 associated with the first and the second adjusting element 49; 51. In the control means 111 or in the circuit arrangement 114 and/or the software program 116 a clear assignment is then implemented or stored between the information and/or dimension $I_{21,x}$ that characterise the position x and/or a positional change Δx of the first cylinder 21 or its bearing device, and/or information $I_{22,yz}$ that prescribes a target position yz and/or a target position change δyz prescribing the tracking of the second cylinder 22. This information $I_{22,yz}$ can also represent a target position for the adjusting drive 112. The aforementioned applies in the same way with regards to the type of association, whereby instead of triplicate values duplicate values can be stored.

In a second variant embodiment of the second embodiment (see e.g. FIG. 10), the two adjusting drives 112, 113 do not engage with moveable limit stops, but directly or indirectly on the adjusting elements 49; 51 to effect their movement. The adjusting drive 112; 113 acts, for example, via a coupling 117; 118, e.g. a push rod 117; 118, on the adjusting element 49; 51 or on the associated adjusting ring 65; 75, or on a tab 78; 79 (76; 77). In this embodiment, the drive mechanism comprising the adjusting drive 112; 113 and the coupling is regulateably- and/or controllably configured in a continuous way or using a number (e.g. >2, in particular >10) of small steps within a setting range greater than zero with respect to its position, and exhibits e.g. an appropriately large inner resistance or comprises an associated locking brake in order to secure the desired position. I.e. the adjusting drive 112; 113 can bring the position of the active limit stop 71; 72 into more than two defined positions that are different from each other. To this end, a drive motor that can be regulated as a stepper motor or relative to its position, or a control circuit with motor-external sensors can be provided. To effect drive, the pushrod 117; 118 can, for example, comprise a thread section or be connected with such, whereby the thread section is driven as output part of a screw drive, for example, through the adjusting drive 112; 113. In this second variant embodiment, the adjusting drive 112; 113 can also assume, in addition to the "tracking," the functionality of throw-on/throw-off, whereby the aforementioned adjusting drives 63; 64 (see e.g. FIG. 4) can be omitted or be formed by the adjusting drives 112; 113.

If in this second alternative of the second embodiment the first cylinder 21 is radially set, e.g. in thrown-off (print-off) position from the impression cylinder 19, the implemented relationship effects a two-sided "tracking" of the second cylinder 21 that is correlated with the setting of the first cylinder 21, i.e. a correlated setting of the two limit stops 71; 72 of the cylinder 22. The target value for the tracking is, e.g. imposed over the target value for the undisturbed throw-on position.

Although the aforementioned forced two-sided tracking was described in relation to the preferable configuration of cylinders 21; 22; 23 as rotational bodies 21; 22; 23 of a printing unit 26; 27, 28, in particular of an Orlof printing unit 26, in principle, it is also applicable to an arrangement and mounting of rotational bodies configured as fluid-conducting rollers of an ink- and/or damping unit, or to a mixed arrangement of three rotational bodies with one or two cylinders 21; 22; 23 of a printing unit 26; 27; 28 together with two or one roller of an ink- and/or damping unit. The first rotational body 21 is then preferably changeable at a distance from a further rotational body 19. The above embodiments described on the basis of the three "cylinders" are thereby accordingly to be applied to the generalized term "rotational body" or also to the special term "roller"

While preferred embodiments of a method and device for setting ink-conducting rotational bodies of a printing press have been set forth fully and completely hereinabove, it will be apparent to one of skill in the art that various changes could be made to the subject invention without departing from the true spirit and scope of the invention which is accordingly to be limited only by the appended claims.

What is claimed is:

1. Method for setting rotational bodies of a printing press having at least a first, a second and a third ink-conducting rotational body (21; 22; 23) which interact in each case in pairs in a thrown-on position, and wherein the second of the at least three rotational bodies (22) is set both against the first of the three rotational bodies (21) and against the third of the three rotational bodies (23) in order to form a two-sided thrown-on position, characterised in that tracking, coupled in a defined way, of the rotational axis (R22) of the second rotational body (22) takes place at the same time as a radial positional change of the rotational axis (R21) of the first rotational body (21), by way of the superimposition of two movements along two non-congruent movement paths which run in a plane which is perpendicular with respect to the rotational axis (R22) of the second rotational body (22).

2. Method according to claim 1, characterised in that the superimposition of the two movements takes place by simultaneous adjustment of a first adjusting element (49), in particular configured as a first eccentric ring (49), and of a second adjusting element (51) configured in particular as a second eccentric ring (51).

3. Method according to claim 2, characterised in that the adjustment of the first and second adjusting member (49; 51) each occurs by a positional change of a limit stop (71; 72) that limits the travel in the direction of the throw-on position.

4. Method according to claim 3, characterised in that the positional change of the limit stops (71; 72) occurs by a mechanical coupling towards the adjusting mechanism (48, 55; 61, 81) of the first rotational body (21).

5. Method according to claim 3, characterized in that the positional change of the two limit stops (71; 72) is effected by at least one adjusting drive (112; 113) that is mechanically independent from the adjusting mechanism (48, 61, 81) of the first rotational body (21).

6. Method according to claim 3, characterised in that in each case a lever (84; 87) surrounding the respective limit stop (71; 72) is pivoted so as to change the position of the limit stops (71; 72).

7. Method according to claim 2, characterised in that the adjustment of the first and second adjusting element (49; 51) is in each case effected by an adjusting drive (112; 113) that directly or indirectly engages with the respective adjusting element (49; 51) that is mechanically independent from the adjusting mechanism (48, 61, 81) of the first rotational body (21).

8. Method according to claim 7, characterised in that a control means (111) acts on the adjusting drive (112; 113) to effect its operation, and the setting occurs by use of an information and/or dimension ($I_{21,x}$) characterising the position (x) and/or a positional change (Δx) of the first rotational body (21) or its mounting arrangement.

9. Device for setting rotational bodies of a printing press having, at least a first, a second and a third ink-conducting rotational body (21; 22; 23), which interact in each case in pairs in a thrown-on position, wherein the second of the at least three rotational bodies (22) is radially movably mounted in a one- or multi-piece frame (47) between the first and the third rotational body (21; 23) such that it can be selectively brought into a thrown-on position in which it is set against the first rotational body (21) and the third rotational body (23), or into a thrown-off position in which it is out of contact with at least one of the two other rotational bodies (21; 23), wherein for mounting of the second rotational body (22) a bearing arrangement (46) is provided at the front comprising two adjusting elements (49; 51) for the radial movement of the second rotational body (22) by way of superimposition of two non-congruent movements each having a radial movement component, characterised in that a forced two-sided tracking of the second rotational body (22) is provided, which comprises a coupling of a movement of the two adjusting elements (49; 51) to a radial movement of the first rotational body (21) in a defined way such that a radial movement of the first rotational body (21) over a travel greater than zero at the same time effects a forced tracking of the two adjusting elements (49; 51) positioning the second rotational body (22) each by a defined travel that is greater than zero.

10. Device according to claim 9, characterised in that for coupling an adjusting mechanism is provided that interacts with the adjusting elements (49; 51) by which the re-adjustment of the two adjusting elements (49; 51) with respect to their movement is mechanically coupled with an adjusting mechanism (48, 55; 61, 81) effecting the radial movement of the first rotational body (21).

11. Device according to claim 10, characterized in that for each adjusting element (49; 51) a limit stop (71; 72) is provided that limits the movement of the respective adjusting element (49; 51) in a setting direction in particular in the direction of a throw-on position, against which in a thrown-on position an adjusting element-fixed counterstop (73; 74) is set, and which is positionally adjustably configured with respect to the position of a contact point with the adjusting element-fixed counterstop (73; 74).

12. Device according to claim 11, characterised in that the two position-adjustable limit stops (71; 72) are mechanically coupled with respect to their movement to an adjusting mechanism (48, 55; 61, 81) effecting the radial movement of the first rotational body (21).

13. Device according to claim 12, characterised in that the mechanical coupling is serially configured by the adjusting mechanism (48, 55; 61, 81) of the first rotational body (21) acting directly or indirectly on one of the two movable limit stops (71; 72), and acting via the movement of the associated adjusting element (49; 51) directly or indirectly on the other of the two limit stops (72; 71).

14. Device according to claim 9, characterised in that the coupling is realized in a circuit-technical and/or control-technical way, wherein an electronic control centre (111) is provided for coupling which acts on at least one adjusting drive (112; 113) that is mechanically independent of an adjusting mechanism (48, 55; 61, 81) that effects the radial movement of the first rotational body (21).

15. Device according to claim 14, characterised in that a clear assignment is implemented in the control centre (111) between an information or dimension ($I_{21,x}$) characterising a position (x) or positional change (Δx) of the first rotational body (21) and an information ($I_{22,y}$) relating to a target position (y; z) or target position change (δy; δz) of information relating to the tracking of the second rotational body (22) by means of the first and/or second adjusting element (49; 51).

16. Device according to claim 9, characterised by the configuration of the second rotational body (22) being a cylinder (22) of an Orlof printing press (26), being a printing unit (03) of a securities printing press.

* * * * *